US012139968B2

(12) United States Patent
Morozov

(10) Patent No.: US 12,139,968 B2
(45) Date of Patent: Nov. 12, 2024

(54) DRILL BIT CUTTER ELEMENTS AND DRILL BITS INCLUDING SAME

(71) Applicant: National Oilwell Varco, L.P., Houston, TX (US)

(72) Inventor: Konstantin E. Morozov, The Woodlands, TX (US)

(73) Assignee: NATIONAL OILWELL VARCO, L.P., Houston, TX (US)

( * ) Notice: Subject to any disclaimer, the term of this patent is extended or adjusted under 35 U.S.C. 154(b) by 44 days.

(21) Appl. No.: 17/770,745

(22) PCT Filed: Sep. 24, 2020

(86) PCT No.: PCT/US2020/052540

§ 371 (c)(1),
(2) Date: Apr. 21, 2022

(87) PCT Pub. No.: WO2021/080728

PCT Pub. Date: Apr. 29, 2021

(65) Prior Publication Data

US 2022/0412170 A1 Dec. 29, 2022

Related U.S. Application Data

(60) Provisional application No. 62/926,177, filed on Oct. 25, 2019.

(51) Int. Cl.
*E21B 10/567* (2006.01)
*E21B 10/55* (2006.01)

(52) U.S. Cl.
CPC ..... *E21B 10/5673* (2013.01); *E21B 10/55* (2013.01)

(58) Field of Classification Search
CPC ... E21B 10/5673; E21B 10/5671; E21B 10/55
See application file for complete search history.

(56) References Cited

U.S. PATENT DOCUMENTS

| | | | |
|---|---|---|---|
| 5,752,573 | A | 5/1998 | Scott et al. |
| 7,757,785 | B2 | 7/2010 | Zhang et al. |
| 8,172,012 | B2 | 5/2012 | Achilles |
| 8,960,337 | B2 | 2/2015 | Hall et al. |

(Continued)

FOREIGN PATENT DOCUMENTS

| | | | |
|---|---|---|---|
| CN | 201513124 | U | 6/2010 |
| WO | 2017/087920 | A1 | 5/2017 |
| WO | 2019/128956 | A1 | 7/2019 |

OTHER PUBLICATIONS

International Patent Application No. PCT/US2020/052540 International Search Report and Written Opinion dated Feb. 2, 2021 (15 pages).

(Continued)

*Primary Examiner* — Kristyn A Hall
(74) *Attorney, Agent, or Firm* — CONLEY ROSE, P.C.

(57) ABSTRACT

A cutter element for a drill bit includes a base portion having a central axis, a first end, and a second end. In addition, the cutter element includes a cutting layer fixably mounted to the first end of the base portion. The cutting layer includes a cutting face distal the base portion. The cutting face includes a first planar surface and a second planar surface that is circumferentially-spaced from the first planar surface. Each planar surface is positioned at an outer periphery of the cutting face adjacent the radially outer surface of the cutting layer. The cutting face also includes a saddle surface including a crown and a pair of lateral side surfaces that slope down and away from the crown toward the radially outer cylindrical surface of the cutting layer. The crown extends from the first planar surface to the second planar surface.

27 Claims, 16 Drawing Sheets

(56) References Cited

U.S. PATENT DOCUMENTS

| | | | | |
|---|---|---|---|---|
| 9,074,435 | B2 | 7/2015 | Scott et al. | |
| 9,109,412 | B2 | 8/2015 | Cox | |
| 9,920,576 | B2 | 3/2018 | Spencer | |
| 2005/0247486 | A1* | 11/2005 | Zhang | E21B 10/5673 175/57 |
| 2005/0269139 | A1 | 12/2005 | Shen et al. | |
| 2007/0175672 | A1 | 8/2007 | Eyre et al. | |
| 2014/0262545 | A1 | 9/2014 | Azar et al. | |
| 2015/0259988 | A1 | 9/2015 | Chen et al. | |
| 2016/0265285 | A1 | 9/2016 | Stockey et al. | |
| 2017/0096859 | A1 | 4/2017 | Spencer | |
| 2018/0363383 | A1 | 12/2018 | Bao et al. | |
| 2019/0010763 | A1 | 1/2019 | Crockett et al. | |
| 2019/0100967 | A1 | 4/2019 | Russell et al. | |
| 2019/0242192 | A1 | 8/2019 | Bellin et al. | |

OTHER PUBLICATIONS

Canadian Office Action dated Jan. 18, 2024, for Canadian Application No. 3,158,620 (5 p.).
Saudi Arabian Examination Report dated Nov. 21, 2023, for Saudi Arabian Application No. 522432382 (11 p.).
English Translation of Saudi Arabian Examination Report dated Nov. 21, 2023, for Saudi Arabian Application No. 522432382 (8 p.).
Partial Search Report dated Oct. 17, 2023, for European Application No. 20878964.4 (17 p.).
European Supplementary Search Report dated Oct. 17, 2023, for European Application No. 20878964.4 (18 p.).
Extended Search Report dated Jan. 25, 2024, for European Application No. 20878964.4 (15 p.).

* cited by examiner

DRILL BIT CUTTER ELEMENTS AND DRILL BITS INCLUDING SAME

CROSS-REFERENCE TO RELATED APPLICATIONS

This application is a National Phase Entry into the U.S. under 35 U.S.C. § 371 of and claims priority to PCT Application No. PCT/US2020/052540, filed Sep. 24, 2020, entitled "Drill Bit Cutter Elements and Drill Bits Including Same," which claims benefit of U.S. provisional patent application Ser. No. 62/926,177 filed Oct. 25, 2019, and entitled "Drill Bit Cutter Elements and Drill Bits Including Same," the entire contents of each being incorporated herein by reference for all purposes.

STATEMENT REGARDING FEDERALLY SPONSORED RESEARCH OR DEVELOPMENT

Not applicable.

BACKGROUND

The disclosure relates generally to drill bits for drilling a borehole in an earthen formation for the ultimate recovery of oil, gas, or minerals. More particularly, the disclosure relates to fixed cutter bits and cutter elements used on such bits.

An earth-boring drill bit is typically mounted on the lower end of a drill string and is rotated by rotating the drill string at the surface or by actuation of downhole motors or turbines, or by both methods. With weight applied to the drill string, the rotating drill bit engages the earthen formation and proceeds to form a borehole along a predetermined path toward a target zone. The borehole thus created will have a diameter generally equal to the diameter or "gage" of the drill bit.

Fixed cutter bits, also known as rotary drag bits, are one type of drill bit commonly used to drill boreholes. Fixed cutter bit designs include a plurality of blades angularly spaced about the bit face. The blades generally project radially outward along the bit body and form flow channels there between. In addition, cutter elements are often grouped and mounted on several blades. The configuration or layout of the cutter elements on the blades may vary widely, depending on a number of factors. One of these factors is the formation itself, as different cutter element layouts engage and cut the various strata with differing results and effectiveness.

The cutter elements disposed on the several blades of a fixed cutter bit are typically formed of extremely hard materials and include a layer of polycrystalline diamond ("PCD") material. In the typical fixed cutter bit, each cutter element or assembly comprises an elongate and generally cylindrical support member which is received and secured in a pocket formed in the surface of one of the several blades. In addition, each cutter element typically has a hard cutting layer of polycrystalline diamond or other superabrasive material such as cubic boron nitride, thermally stable diamond, polycrystalline cubic boron nitride, or ultrahard tungsten carbide (meaning a tungsten carbide material having a wear-resistance that is greater than the wear-resistance of the material forming the substrate) as well as mixtures or combinations of these materials. The cutting layer is exposed on one end of its support member, which is typically formed of tungsten carbide. For convenience, as used herein, the phrase "polycrystalline diamond cutter" or "PDC" may be used to refer to a fixed cutter bit ("PDC bit") or cutter element ("PDC cutter element") employing a hard cutting layer of polycrystalline diamond or other superabrasive material such as cubic boron nitride, thermally stable diamond, polycrystalline cubic boron nitride, or ultrahard tungsten carbide.

While the bit is rotated, drilling fluid is pumped through the drill string and directed out of the face of the drill bit. The fixed cutter bit typically includes nozzles or fixed ports spaced about the bit face that serve to inject drilling fluid into the flow passageways between the several blades. The flowing fluid performs several important functions. The fluid removes formation cuttings from the bit's cutting structure. Otherwise, accumulation of formation materials on the cutting structure may reduce or prevent the penetration of the cutting structure into the formation. In addition, the fluid removes cut formation materials from the bottom of the hole. Failure to remove formation materials from the bottom of the hole may result in subsequent passes by cutting structure to re-cut the same materials, thereby reducing the effective cutting rate and potentially increasing wear on the cutting surfaces. The drilling fluid and cuttings removed from the bit face and from the bottom of the hole are forced from the bottom of the borehole to the surface through the annulus that exists between the drill string and the borehole sidewall. Further, the fluid removes heat, caused by contact with the formation, from the cutter elements in order to prolong cutter element life. Thus, the number and placement of drilling fluid nozzles, and the resulting flow of drilling fluid, may significantly impact the performance of the drill bit.

Without regard to the type of bit, the cost of drilling a borehole for recovery of hydrocarbons may be very high and is proportional to the length of time it takes to drill to the desired depth and location. The time required to drill the well, in turn, is greatly affected by the cutting efficiency of the cutting structure on the drill bit. Accordingly, it is desirable to employ drill bits which will drill faster and longer, and which are usable over a wider range of formation hardness.

BRIEF SUMMARY OF THE DISCLOSURE

Embodiments of cutter elements for drill bits configured to drill boreholes in subterranean formations are disclosed herein. In one embodiment, a cutter element comprises a base portion having a central axis, a first end, a second end, and a radially outer cylindrical surface extending axially from the first end. In addition, the cutter element comprises a cutting layer fixably mounted to the first end of the base portion. The cutting layer includes a cutting face distal the base portion and a radially outer cylindrical surface extending axially from the cutting face to the radially outer cylindrical surface of the base portion. The radially outer cylindrical surface of the cutting layer is contiguous with the radially outer cylindrical surface of the base portion. The cutting face comprises a first planar surface and a second planar surface that is circumferentially-spaced from the first planar surface. Each planar surface is positioned at an outer periphery of the cutting face adjacent the radially outer surface of the cutting layer. The cutting face also comprises a saddle surface including a crown and a pair of lateral side surfaces that slope down and away from the crown toward the radially outer cylindrical surface of the cutting layer. The crown extends from the first planar surface to the second planar surface.

In another embodiment, a cutter element comprises a base portion having a central axis, a first end, a second end, and a radially outer cylindrical surface extending axially from the first end. In addition, the cutter element comprises a cutting layer fixably mounted to the first end of the base portion. The cutting layer includes a cutting face distal the base portion and a radially outer cylindrical surface extending axially from the cutting face to the radially outer cylindrical surface of the base portion. The radially outer cylindrical surface of the cutting layer is contiguous with the radially outer cylindrical surface of the base portion. The cutting face comprises a pair of circumferentially-spaced and radially opposed planar surfaces. In addition, the cutting face comprises a hyperbolic paraboloid surface including a crown extending between the pair of planar surfaces and a pair of lateral side surfaces sloping downward and away from the crown toward the radially outer cylindrical surface of the cutting layer.

Embodiments of methods for manufacturing cutter elements for drill bits. In one embodiment, a method comprises (a) forming a base portion having a central axis, a first end, a second end, and a radially outer cylindrical surface extending axially from the first end. In addition, the method comprises (b) forming a cutting layer that includes a cutting face and a radially outer cylindrical surface extending axially from the cutting face. Further, the method comprises (c) fixably mounting the cutting layer to the base portion such that the radially outer cylindrical surface of the cutting layer extends axially from the cutting face to the radially outer cylindrical surface of the base portion and the radially outer cylindrical surface of the cutting layer is contiguous with the radially outer cylindrical surface of the base portion. The cutting face comprises a pair of circumferentially-spaced, radially opposed planar surfaces. The cutting face also comprises a hyperbolic paraboloid surface extending between the pair of planar surfaces. Still further, the method comprises (d) machining the planar surfaces to have a lower average surface roughness Ra than the hyperbolic paraboloid surface.

Embodiments described herein comprise a combination of features and advantages intended to address various shortcomings associated with certain prior devices, systems, and methods. The foregoing has outlined rather broadly the features and technical advantages of the invention in order that the detailed description of the invention that follows may be better understood. The various characteristics described above, as well as other features, will be readily apparent to those skilled in the art upon reading the following detailed description, and by referring to the accompanying drawings. It should be appreciated by those skilled in the art that the conception and the specific embodiments disclosed may be readily utilized as a basis for modifying or designing other structures for carrying out the same purposes of the invention. It should also be realized by those skilled in the art that such equivalent constructions do not depart from the spirit and scope of the invention as set forth in the appended claims.

BRIEF DESCRIPTION OF THE DRAWINGS

For a detailed description of the preferred embodiments of the invention, reference will now be made to the accompanying drawings in which.

DETAILED DESCRIPTION OF THE PREFERRED EMBODIMENTS

Figure 1:
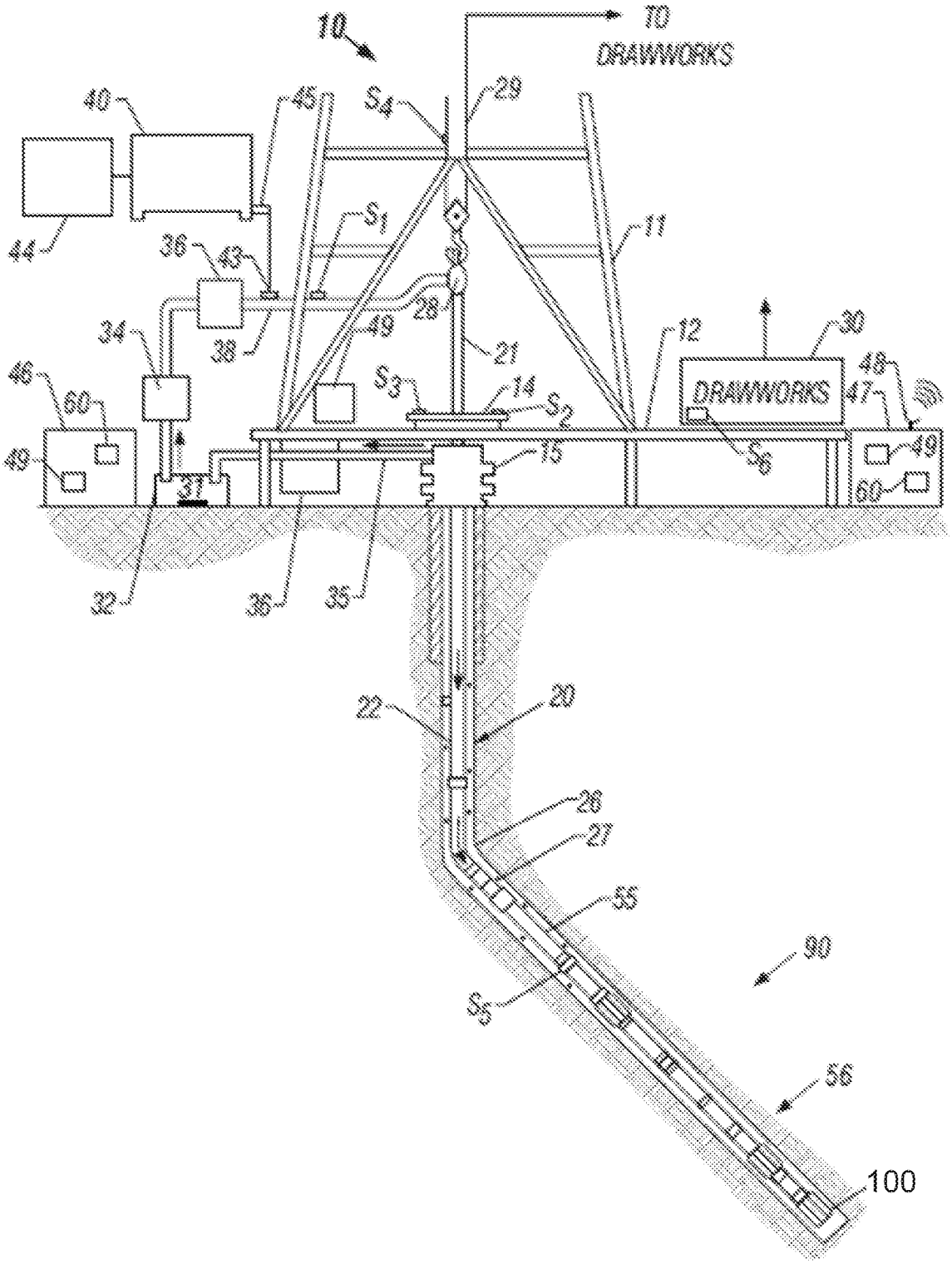
FIG. 1 is a schematic view of a drilling system including an embodiment of a drill bit with a plurality of cutter elements in accordance with the principles described herein.

The following discussion is directed to various exemplary embodiments. However, one skilled in the art will understand that the examples disclosed herein have broad application, and that the discussion of any embodiment is meant only to be exemplary of that embodiment, and not intended to suggest that the scope of the disclosure, including the claims, is limited to that embodiment.

Certain terms are used throughout the following description and claims to refer to particular features or components. As one skilled in the art will appreciate, different persons may refer to the same feature or component by different names. This document does not intend to distinguish between components or features that differ in name but not function. The drawing figures are not necessarily to scale. Certain features and components herein may be shown exaggerated in scale or in somewhat schematic form and some details of conventional elements may not be shown in interest of clarity and conciseness.

In the following discussion and in the claims, the terms "including" and "comprising" are used in an open-ended fashion, and thus should be interpreted to mean "including, but not limited to . . . ." Also, the term "couple" or "couples" is intended to mean either an indirect or direct connection. Thus, if a first device couples to a second device, that connection may be through a direct connection, or through an indirect connection via other devices, components, and connections. In addition, as used herein, the terms "axial" and "axially" generally mean along or parallel to a central axis (e.g., central axis of a body or a port), while the terms "radial" and "radially" generally mean perpendicular to the central axis. For instance, an axial distance refers to a distance measured along or parallel to the central axis, and a radial distance means a distance measured perpendicular to the central axis. Any reference to up or down in the description and the claims will be made for purposes of clarity, with "up", "upper", "upwardly" or "upstream" meaning toward the surface of the borehole and with "down", "lower", "downwardly" or "downstream" meaning toward the terminal end of the borehole, regardless of the borehole orientation. As used herein, the terms "approximately," "about," "substantially," and the like mean within 10% (i.e., plus or minus 10%) of the recited value. Thus, for example, a recited angle of "about 80 degrees" refers to an angle ranging from 72 degrees to 88 degrees.

As previously described, the length of time it takes to drill to the desired depth and location impacts the cost of drilling operations. The shape and positioning of the cutter elements impact bit durability and rate of penetration (ROP) and thus, are important to the success of a particular bit design. Embodiments described herein are directed to cutter elements for fixed cutter drill bits with geometries that offer the potential to improve cutting element efficiency, thereby providing increased drill bit ROP and durability. In some embodiments, cutter elements disclosed herein can be reused after the initial cutting edge is sufficiently worn, which offers the potential to enhance the useful life of such cutter elements.

Referring now to FIG. 1, a schematic view of an embodiment of a drilling system 10 in accordance with the principles described herein is shown. Drilling system 10 includes a derrick 11 having a floor 12 supporting a rotary table 14 and a drilling assembly 90 for drilling a borehole 26 from derrick 11. Rotary table 14 is rotated by a prime mover such as an electric motor (not shown) at a desired rotational speed and controlled by a motor controller (not shown). In other embodiments, the rotary table (e.g., rotary table 14) may be augmented or replaced by a top drive suspended in the derrick (e.g., derrick 11) and connected to the drillstring (e.g., drillstring 20).

Drilling assembly 90 includes a drillstring 20 and a drill bit 100 coupled to the lower end of drillstring 20. Drillstring 20 is made of a plurality of pipe joints 22 connected end-to-end, and extends downward from the rotary table 14 through a pressure control device 15, such as a blowout preventer (BOP), into the borehole 26. The pressure control device 15 is commonly hydraulically powered and may contain sensors for detecting certain operating parameters and controlling the actuation of the pressure control device 15. Drill bit 100 is rotated with weight-on-bit (WOB) applied to drill the borehole 26 through the earthen formation. Drillstring 20 is coupled to a drawworks 30 via a kelly joint 21, swivel 28, and line 29 through a pulley. During drilling operations, drawworks 30 is operated to control the WOB, which impacts the rate-of-penetration of drill bit 100 through the formation. In this embodiment, drill bit 100 can be rotated from the surface by drillstring 20 via rotary table 14 and/or a top drive, rotated by downhole mud motor 55 disposed along drillstring 20 proximal bit 100, or combinations thereof (e.g., rotated by both rotary table 14 via drillstring 20 and mud motor 55, rotated by a top drive and the mud motor 55, etc.). For example, rotation via downhole motor 55 may be employed to supplement the rotational power of rotary table 14, if required, and/or to effect changes in the drilling process. In either case, the rate-of-penetration (ROP) of the drill bit 100 into the borehole 26 for a given formation and a drilling assembly largely depends upon the WOB and the rotational speed of bit 100.

During drilling operations a suitable drilling fluid 31 is pumped under pressure from a mud tank 32 through the drillstring 20 by a mud pump 34. Drilling fluid 31 passes from the mud pump 34 into the drillstring 20 via a desurger 36, fluid line 38, and the kelly joint 21. The drilling fluid 31 pumped down drillstring 20 flows through mud motor 55 and is discharged at the borehole bottom through nozzles in face of drill bit 100, circulates to the surface through an annular space 27 radially positioned between drillstring 20 and the sidewall of borehole 26, and then returns to mud tank 32 via a solids control system 36 and a return line 35. Solids control system 36 may include any suitable solids control equipment known in the art including, without limitation, shale shakers, centrifuges, and automated chemical additive systems. Control system 36 may include sensors and automated controls for monitoring and controlling, respectively, various operating parameters such as centrifuge rpm. It should be appreciated that much of the surface equipment for handling the drilling fluid is application specific and may vary on a case-by-case basis.

Figure 2:
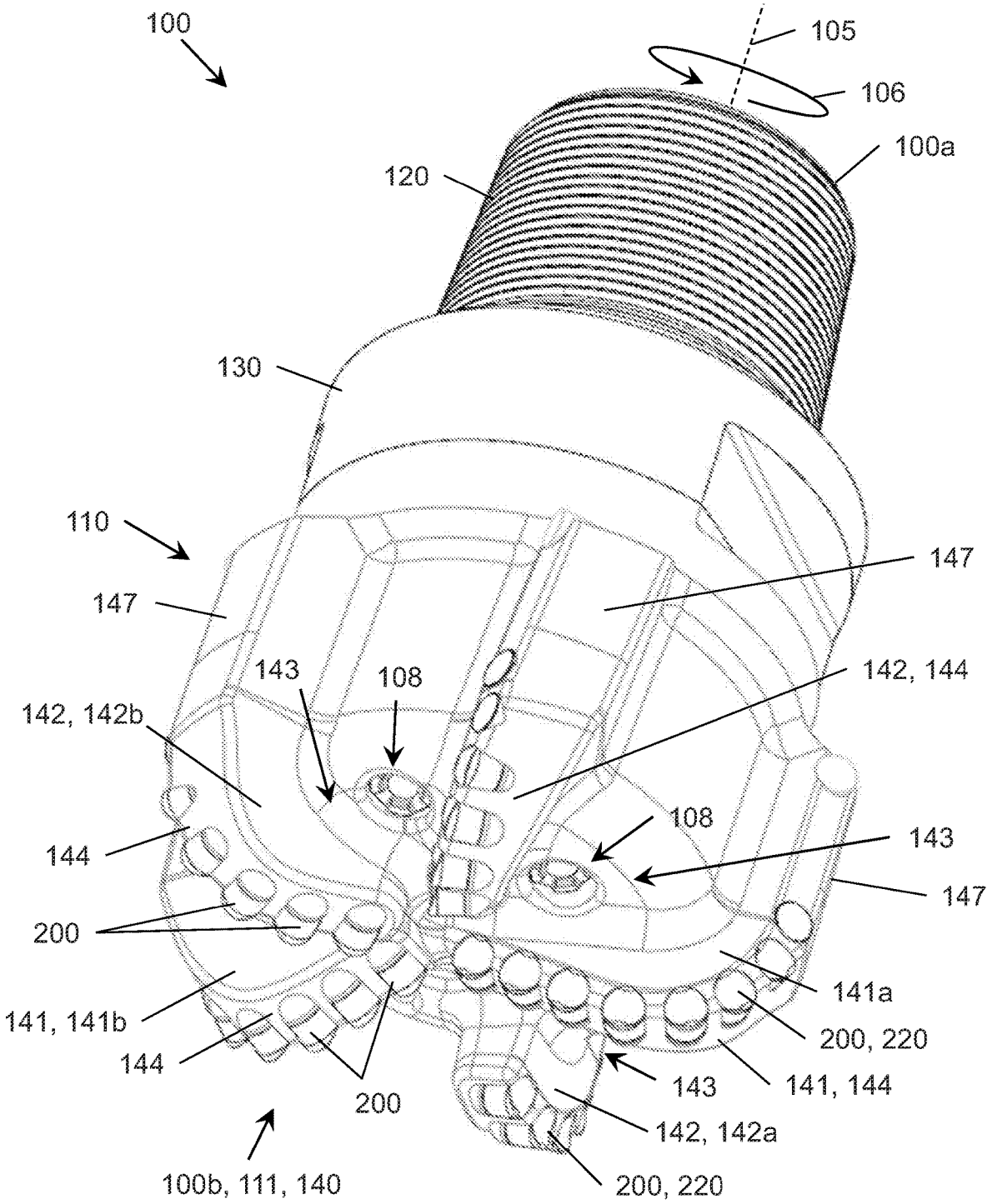
FIG. 2 is a perspective view of the drill bit of FIG. 1.
Figure 3:
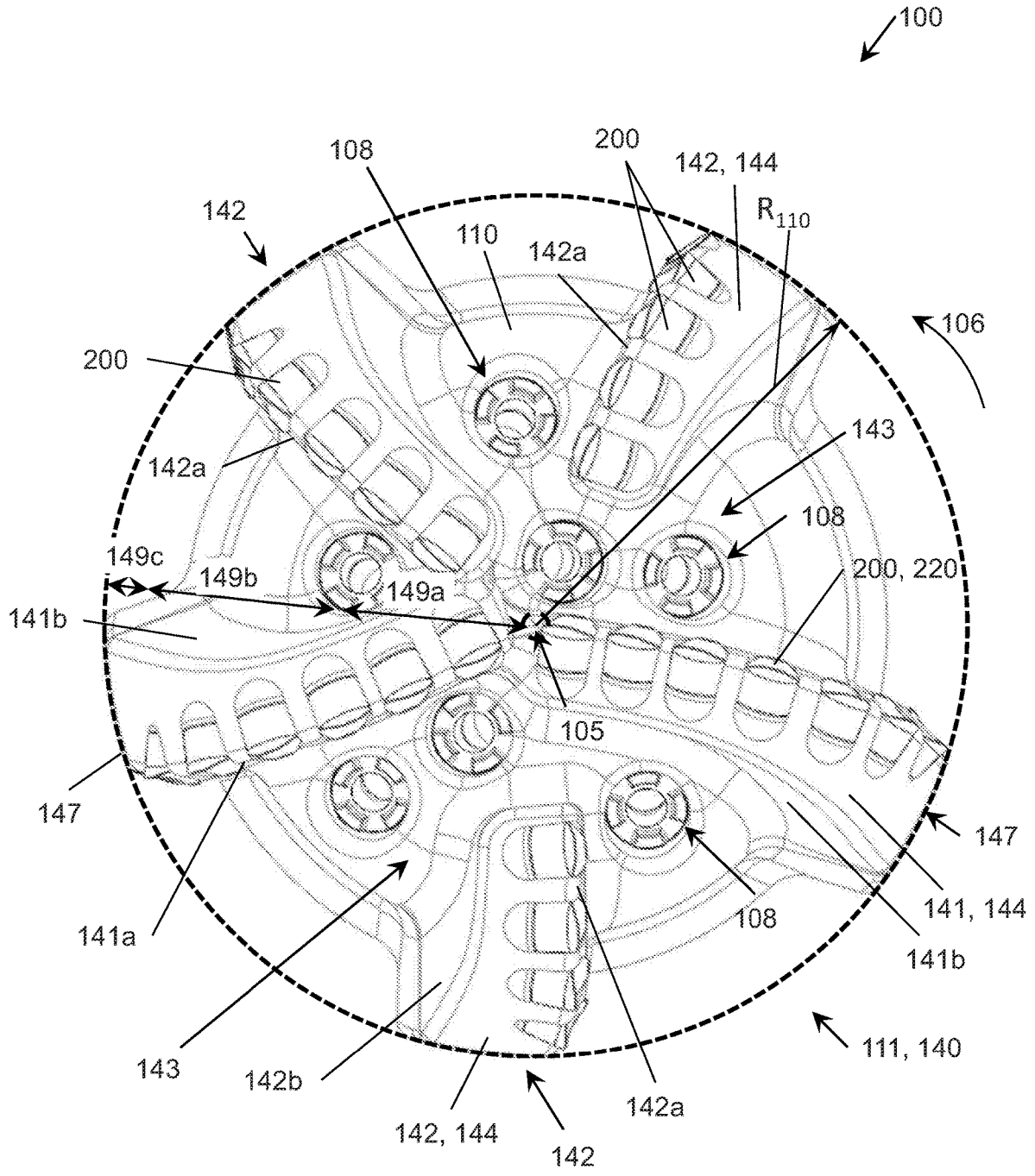
FIG. 3 is a face or bottom end view of the drill bit of FIG. 2.

Referring now to FIGS. 2 and 3, drill bit 100 is a fixed cutter bit, sometimes referred to as a drag bit, and is designed for drilling through formations of rock to form a borehole. Bit 100 has a central or longitudinal axis 105, a first or uphole end 100*a*, and a second or downhole end 100*b*. Bit 100 rotates about axis 105 in the cutting direction represented by arrow 106. In addition, bit 100 includes a bit body 110 extending axially from downhole end 100*b*, a threaded connection or pin 120 extending axially from uphole end 100*a*, and a shank 130 extending axially between pin 120 and body 110. Pin 120 couples bit 100 to drill string 20, which is employed to rotate the bit 100 to drill the borehole 26. Bit body 110, shank 130, and pin 120 are coaxially aligned with axis 105, and thus, each has a central axis coincident with axis 105.

The portion of bit body 110 that faces the formation at downhole end 100*b* includes a bit face 111 provided with a cutting structure 140. Cutting structure 140 includes a plurality of blades 141, 142, which extend from bit face 111. In this embodiment, cutting structure 140 includes a plurality of angularly spaced-apart primary blades 141 and a plurality of angularly spaced apart secondary blades 142. Further, in this embodiment, the plurality of blades (e.g., primary blades 141, and secondary blades 142) are uniformly angularly spaced on bit face 111 about bit axis 105. In this embodiment, bit 100 includes five total blades 141, 142—two primary blades 141 and three secondary blades 142. The five blades 141, 142 are uniformly angularly spaced about 72° apart. In other embodiments, the blades (e.g., blades 141, 142 may be non-uniformly circumferentially spaced about bit face 111). Although bit 100 is shown as having two primary blades 141 and three secondary blades 142, in other embodiments, the bit (e.g., bit 100) may comprise any suitable number of primary and secondary blades such as three primary blades and three secondary blades or two primary blades and four secondary blades.

In this embodiment, primary blades 141 and secondary blades 142 are integrally formed as part of, and extend from, bit body 110 and bit face 111. Primary blades 141 and secondary blades 142 extend generally radially along bit face 111 and then axially along a portion of the periphery of bit 100. In particular, primary blades 141 extend radially from proximal central axis 105 toward the periphery of bit body 110. Primary blades 141 and secondary blades 142 are separated by drilling fluid flow courses or junk slots 143. Each blade 141, 142 has a leading edge or side 141*a*, 142*a*, respectively, and a trailing edge or side 141*b*, 142*b*, respectively, relative to the direction of rotation 106 of bit 100.

Referring still to FIGS. 2 and 3, each blade 141, 142 includes a cutter-supporting surface 144 for mounting a plurality of cutter elements 200. In particular, cutter elements 200 are arranged adjacent one another in a radially extending row proximal the leading edge of each primary blade 141 and each secondary blade 142. In this embodiment, each cutter element 200 has substantially the same size and geometry, which will be described in more detail below.

As will also be described in more detail below, each cutter element 200 has a cutting or end face 220. In the embodiments described herein, each cutter element 200 is mounted such that its end face 220 is generally forward-facing. As used herein, "forward-facing" is used to describe the orientation of a surface that is substantially perpendicular to, or at an acute angle relative to, the cutting direction of the bit (e.g., cutting direction 106 of bit 100).

Referring still to FIGS. 2 and 3, bit body 110 further includes gage pads 147 of substantially equal axial length measured generally parallel to bit axis 105. Gage pads 147 are circumferentially-spaced about the radially outer surface of bit body 110. Specifically, one gage pad 147 intersects and extends from each blade 141, 142. In this embodiment, gage pads 147 are integrally formed as part of the bit body 110. In general, gage pads 147 can help maintain the size of the borehole by a rubbing action when cutter elements 200 wear slightly under gage. Gage pads 147 also help stabilize bit 100 against vibration.

Figure 4:
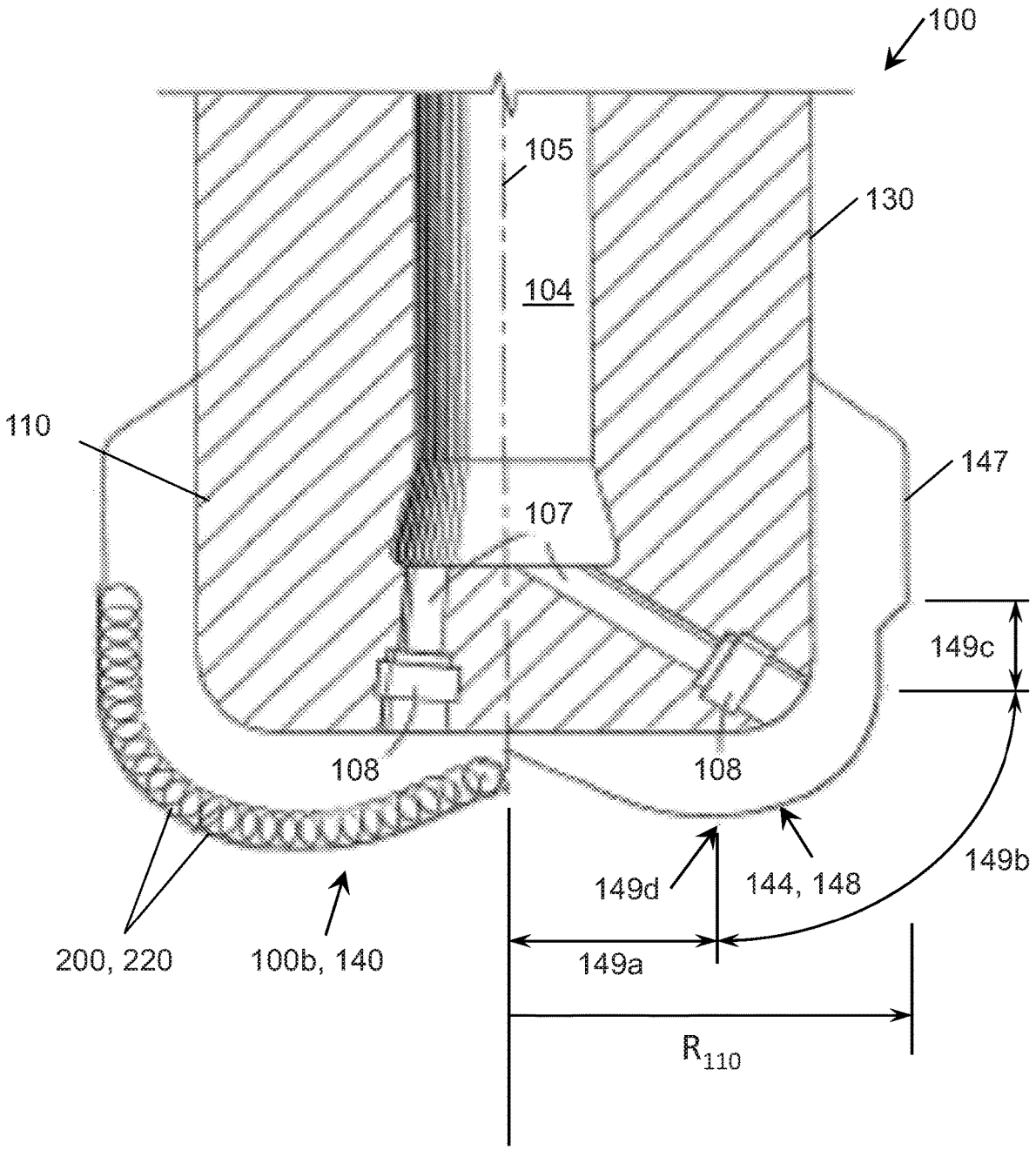
FIG. 4 is a partial cross-sectional view of the bit shown in FIG. 2 with the blades and the cutting faces of the cutter elements rotated into a single composite profile.

Referring now to FIG. 4, an exemplary profile of bit body 110 is shown as it would appear with blades 141, 142 and end faces 220 rotated into a single rotated profile. In rotated profile view, blades 141, 142 of bit body 110 form a combined or composite blade profile 148 generally defined by cutter-supporting surfaces 144 of blades 141, 142. In this embodiment, the profiles of surfaces 144 of blades 141, 142 are generally coincident with each other, thereby forming a single composite blade profile 148.

Composite blade profile 148 and bit face 111 may generally be divided into three regions conventionally labeled cone region 149*a*, shoulder region 149*b*, and gage region 149*c*. Cone region 149*a* comprises the radially innermost region of bit body 110 and composite blade profile 148 extending from bit axis 105 to shoulder region 149*b*. In this embodiment, cone region 149*a* is generally concave. Adjacent cone region 149*a* is the generally convex shoulder region 149*b*. The transition between cone region 149*a* and shoulder region 149*b*, typically referred to as the nose 149*d*, occurs at the axially outermost portion of composite blade profile 148 where a tangent line to the blade profile 148 has a slope of zero. Moving radially outward, adjacent shoulder region 149*b* is the gage region 149*c* which extends substantially parallel to bit axis 105 at the outer radial periphery of composite blade profile 148. As shown in composite blade profile 148, gage pads 147 define the gage region 149*c* and the outer radius $R_{110}$ of bit body 110. Outer radius $R_{110}$ extends to and therefore defines the full gage diameter of bit body 110. As used herein, the term "full gage diameter" refers to elements or surfaces extending to the full, nominal gage of the bit diameter.

Referring now to FIGS. 3 and 4, moving radially outward from bit axis 105, bit face 111 includes cone region 149*a*, shoulder region 149*b*, and gage region 149*c* as previously described. Primary blades 141 extend radially along bit face 111 from within cone region 149*a* proximal bit axis 105 toward gage region 149*c* and outer radius $R_{110}$. Secondary blades 142 extend radially along bit face 111 from proximal nose 149*d* toward gage region 149*c* and outer radius $R_{110}$. Thus, in this embodiment, each primary blade 141 and each secondary blade 142 extends substantially to gage region 149*c* and outer radius $R_{110}$. In this embodiment, secondary blades 142 do not extend into cone region 149*a*, and thus, secondary blades 142 occupy no space on bit face 111 within cone region 149*a*. Cutter elements 200 are provided in cone region 149*a*, shoulder region 149*b*, and gage region 149*c*. Although a specific embodiment of bit body 110 has been shown in described, one skilled in the art will appreciate that numerous variations in the size, orientation, and locations of the blades (e.g., primary blades 141, secondary blades, 142, etc.), and cutter elements (e.g., cutter elements 200) are possible.

As best shown in FIG. 4, bit 100 includes an internal plenum 104 extending axially from uphole end 100*a* through pin 120 and shank 130 into bit body 110. Plenum 104 permits drilling fluid to flow from the drill string 20 into bit 100. Body 110 is also provided with a plurality of flow passages 107 extending from plenum 104 to downhole end 100*b*. A nozzle 108 is seated in the lower end of each flow passage 107. Together, passages 107 and nozzles 108 distribute drilling fluid around cutting structure 140 to flush away formation cuttings and to remove heat from cutting structure 140, and more particularly cutter elements 145, during drilling.

Referring now to FIGS. 5A-5D, one cutter element 200 is shown. Although only one cutter element 200 is shown in FIGS. 5A-5D, it is to be understood that all cutter elements 200 of bit 100 are the same. In general, bit 100 may include any number of cutter elements 200, and further, cutter elements 200 can be used in connection with different cutter elements (e.g., cutter elements having geometries different than cutter element 200) on bit 100.

In this embodiment, cutter element 200 includes a base or substrate 201 and a cutting disc or layer 210 bonded to the substrate 201. Cutting layer 210 and substrate 201 meet at a reference plane of intersection 209 that defines the location at which substrate 201 and cutting layer 210 are fixably attached. In this embodiment, substrate 210 is made of tungsten carbide and cutting layer 210 is made of an ultrahard material such as polycrystalline diamond (PCD) or other superabrasive material. Part and/or all of the diamond in cutting layer 210 may be leached, finished, polished, and/or otherwise treated to enhance durability, efficiency and/or effectiveness. While cutting layer 210 is shown as a single layer of material mounted to substrate 210, in general, the cutting layer (e.g., layer 210) may be formed of one or more layers of one or more materials. In addition, although substrate 201 is shown as a single, homogenous material, in general, the substrate (e.g., substrate 201) may be formed of one or more layers of one or more materials.

Substrate 201 has a central axis 205, a first end 201*a* bonded to cutting layer 210 at an interface disposed in a plane of intersection 209, a second end 201*b* opposite end 201*a* and distal cutting layer 210, and a radially outer surface 202 extending axially between ends 201*a*, 201*b*. In this embodiment, substrate 201 has a planar surface at each end 201*a*, 201*b* that is oriented perpendicular to axis 205. Thus, plane of intersection 209 disposed at end 201*a* is defined by a plane oriented perpendicular to axis 205 at the intersection of substrate 201 and cutting layer 210. In this embodiment, substrate 201 is generally cylindrical, and thus, outer surface 202 is generally cylindrical.

Figure 5A:
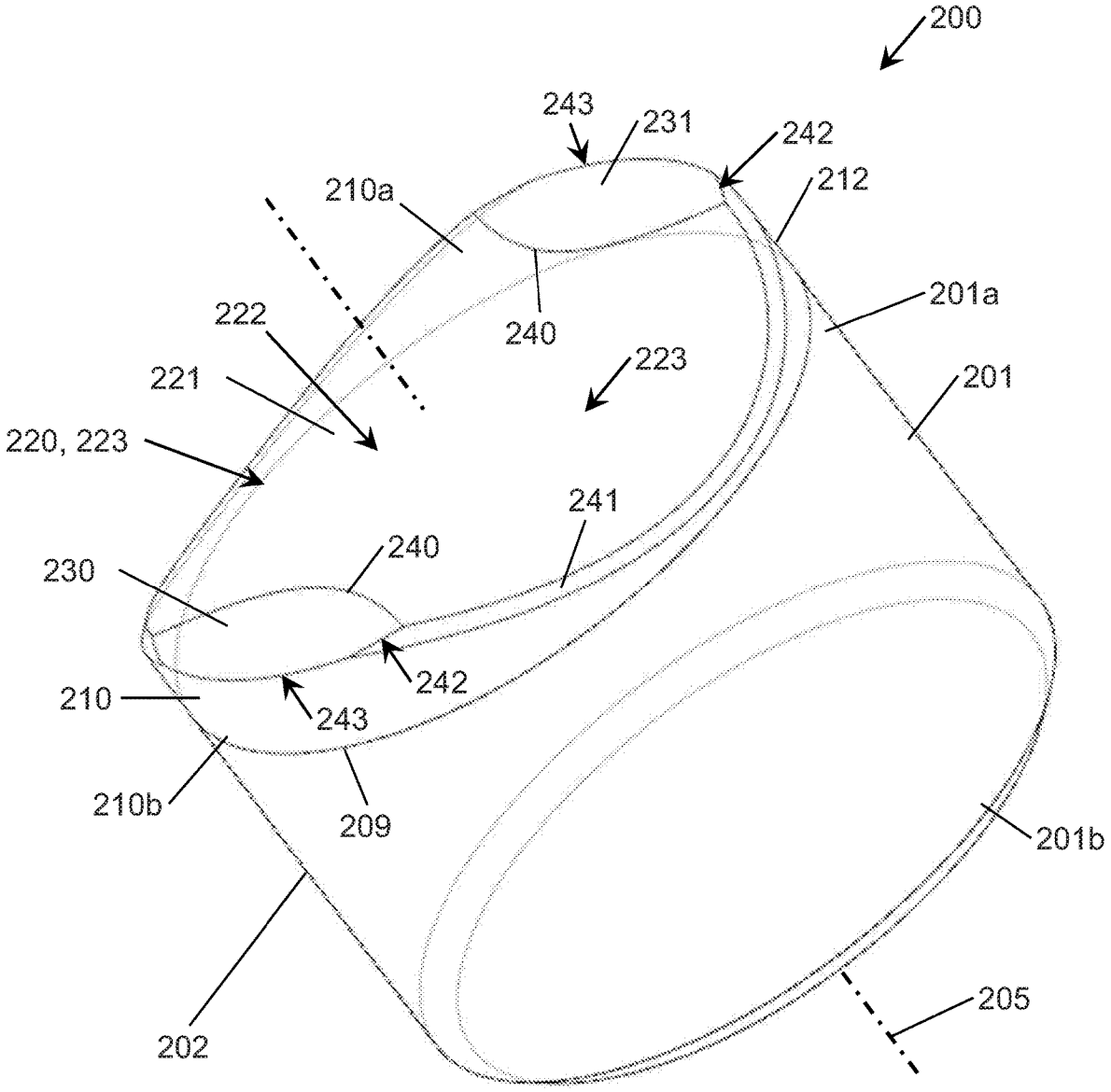
FIGS. 5A-5D are perspective, top, front side, and lateral side views, respectively, of one of the cutter elements of the drill bit of FIG. 2.
Figure 5B:
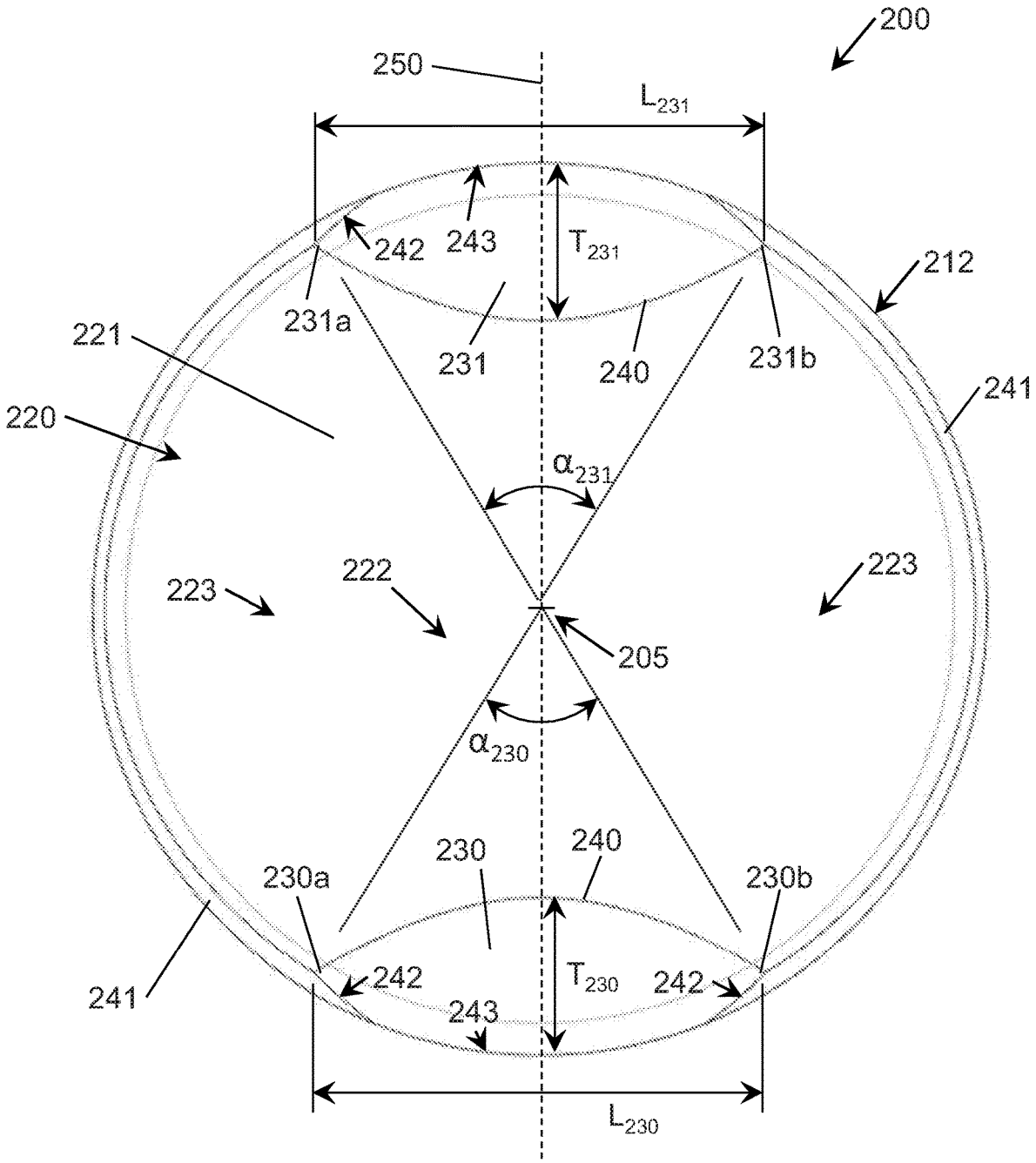
Figure 5C:
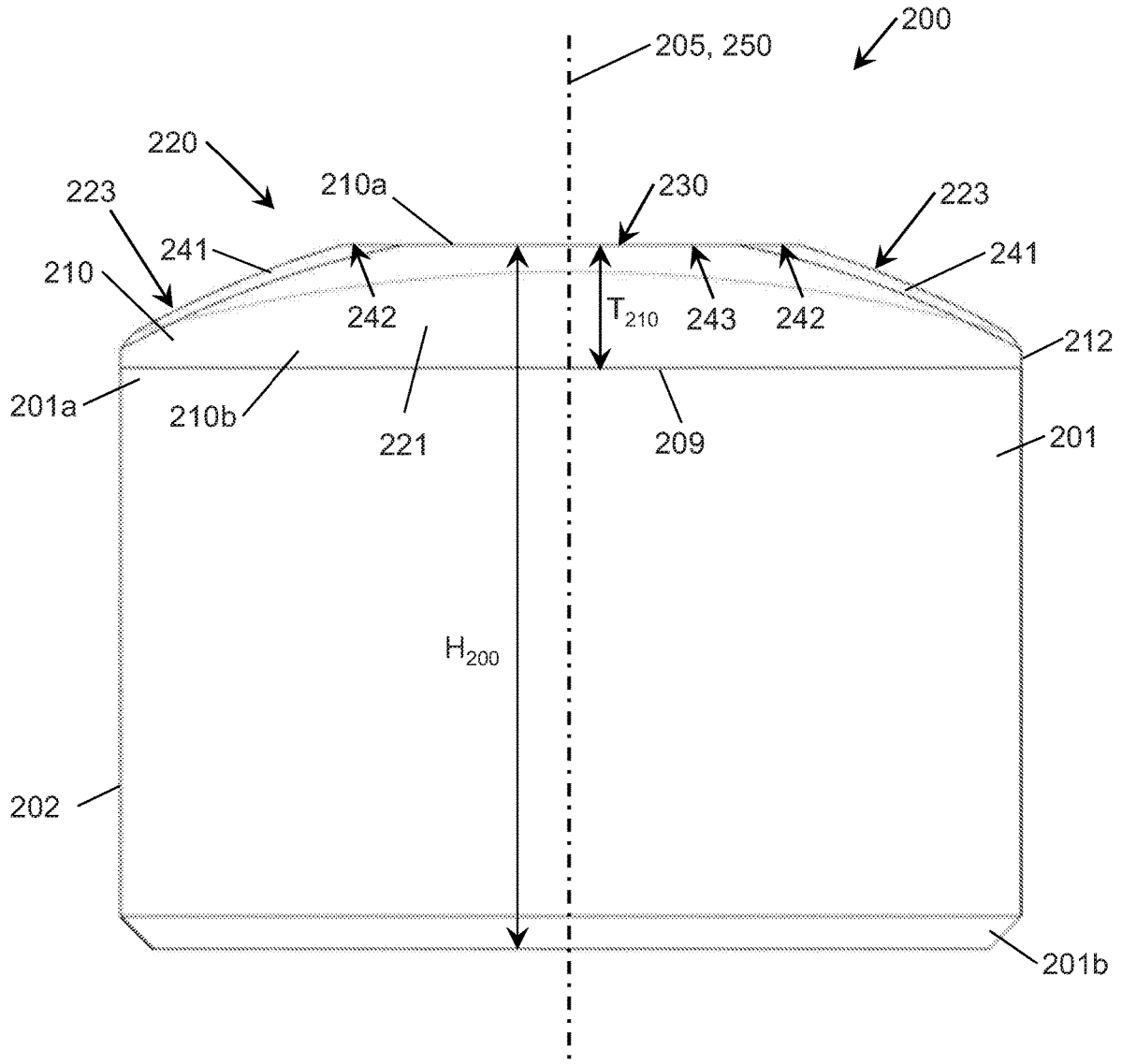
Figure 5D:
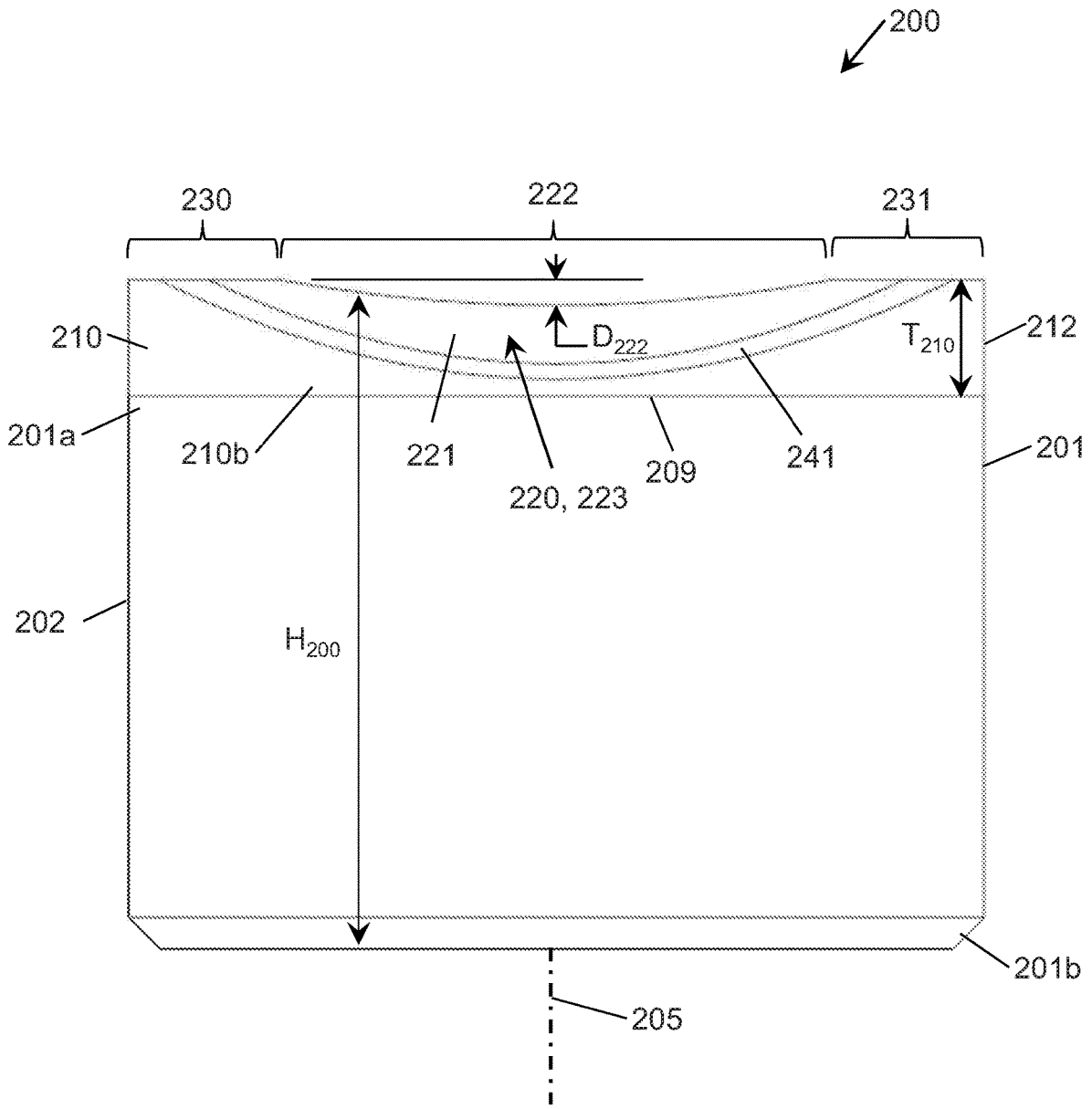

Referring still to FIGS. 5A-5D, cutting layer 210 has a first end 210*a* distal substrate 201, a second end 210*b* bonded to end 201*a* of substrate 201 at plane of intersection 209, and a radially outer surface 212 extending axially between ends 210*a*, 210*b*. In this embodiment, cutting layer 210 is generally disc-shaped, and thus, outer surface 212 is generally cylindrical. In addition, outer surfaces 202, 212 are coextensive and contiguous such that there is a generally smooth transition moving axially between outer surfaces 202, 212. The outer surface of cutting layer 210 at first end 210*a* defines the end face 220 of cutter element 200 and is designed and shaped to engage and shear the formation during drilling operations. As best shown in FIGS. 5C and 5D, cutter element 200 has a height $H_{200}$ in side view (front and lateral side views) measured axially from end 201*b* to end face 220 and end 201*a*, and cutting layer 210 has a thickness in side view (front and lateral side views) measured axially from end 210*a* to plane of intersection 209 and end 210*b*.

In this embodiment, end face 220 includes a saddle surface 221 and a plurality of discrete, circumferentially-spaced regions or surfaces 230, 231 that intersect saddle surface 221 at curved boundaries or edges 240. Saddle surface 221 is a hyperbolic paraboloid surface that is convex or bowed outward in the front side view and the rear side view (front side view shown in FIG. 5C), and generally concave or bowed inward in both lateral side views (one lateral side view shown in FIG. 5D). Thus, saddle surface 221 may be described as having an elongate concave peak or crown 222 that extends linearly in top view (FIG. 5B) from surface 230 to surface 231 and a pair of convex flanks or lateral side surfaces 223 that generally slope downward and laterally away from opposite sides of crown 222 toward outer surface 212. Surfaces 230, 231 are disposed at opposite ends of crown 222.

As best shown in the lateral side view (FIG. 5D), crown 222 has a depth $D_{222}$ measured axially from a plane oriented perpendicular to axis 205 and containing the axially uppermost point or surface along end face 220 of cutting layer 210 to crown 222. As will be described in more detail below, in this embodiment, surfaces 230, 231 are disposed in a plane oriented perpendicular to axis 205 and define the uppermost surface(s) along end face 220, and thus, the depth $D_{222}$ of crown 222 is the distance measured axially from the plane containing surfaces 230, 231 to crown 222 in lateral side view (FIG. 5D). In embodiments described herein, the ratio of the maximum depth $D_{222}$ of crown to the maximum thickness $T_{210}$ of cutting layer is preferably at least 0.10. The change in the slope of crown 222 moving from each surface 230, 231 toward axis 205 in lateral side view (FIG. 5D) can be varied and optimized based on a variety of factors including, without limitation, material composition of the cutting layer (e.g., layer 210) and the desired aggressiveness.

In this embodiment, crown 222 is centered relative to axis 205, and further, saddle surface 221 is symmetric across a reference plane 250 (FIG. 5B) that contains axis 205, bisects cutter element 200 (e.g., divides cutter element 200 in half), and extends along crown 222. It should be appreciated that saddle surface 221 is smoothly and continuously contoured. As used herein, the term "continuously contoured" may be used to describe surfaces and profiles that are smoothly and continuously curved so as to be free of sharp edges and/or transitions with radii less than 0.5 in. In this embodiment, a chamfer or bevel 241 is provided between saddle surface 221 and cylindrical outer surface 212 along the outer periphery of end face 220. Chamfer 241 extends from saddle surface 221 to outer surface 212 and is oriented at an acute angle relative to central axis 205 in side view.

In this embodiment, surfaces 230, 231 are smoother than saddle surface 221. In particular, surfaces 230, 231 are polished to an average surface roughness Ra that is less than the average surface roughness Ra of saddle surface 221. The average surface roughness Ra of each surface 230, 231 preferably ranges from 0.05 micron to 1.0 micron, and more preferably ranges from 0.05 micron to 0.2 micron, whereas the average surface roughness Ra of saddle surface 221 ranges from 0.05 micron to 1.5 micron.

Referring still to FIGS. 5A-5E, surfaces 230, 231 are circumferentially-spaced about end face 220 and are positioned at the outer periphery of end face 220 radially adjacent to cylindrical outer surface 212. In this embodiment, two surfaces 230, 231 are provided on end face 220 and are uniformly circumferentially-spaced 180° apart. Thus, surfaces 230, 231 are radially opposed (across axis 205) and disposed on opposite ends of end face 220. More specifically, surfaces 230, 231 are disposed at opposite ends of crown 222 and are centered on and symmetric about reference plane 250. In addition, each surface 230, 231 is radially positioned between saddle surface 221 and outer cylindrical surface 212. As best shown in FIG. 5B, the radially inner boundary of each surface 230, 231 is generally convex in top view, and thus, edges 240 are generally U-shaped.

As best shown in FIGS. 5C and 5D, in this embodiment, each surface 230, 231 is a flat, and thus, may also be referred to as a planar surface or facet. In particular, each surface 230, 231 is disposed in a plane oriented perpendicular to axis 205 and reference plane 250. In this embodiment, both surfaces 230, 231 are disposed in a common plane oriented perpendicular to axis 205 and reference plane 250. Thus, the height $H_{200}$ of cutter element 200 is uniform and constant along surfaces 230, 231. It should also be appreciated that since surfaces 230, 231 are disposed at opposite ends of crown 222, which is concave therebetween, and lateral surfaces 223 generally slope downward moving from surfaces 230, 231 to chamfers 241, the height $H_{200}$ of cutter element 200 is maximum along surfaces 230, 231. The height of cutter element 200 generally decreases moving from each surface 230, 231 to axis 205 along crown 222, and further, the height $H_{200}$ generally decreases moving from each surface 230, 231 along each lateral surface 223. Although surfaces 230, 231 are disposed in a common plane oriented perpendicular to axis 205 in this embodiment, in other embodiments, one or more of the planar, discrete, circumferentially-spaced surfaces (e.g., surfaces 230, 231) may be disposed in a plane oriented at an acute angle relative to the central axis (e.g., axis 205) in front side view and/or lateral side view.

Referring now to FIG. 5B, each surface 230, 231 has circumferential ends 230*a*, 230*b*, 231*a*, 231*b*, respectively. In this embodiment, chamfer 241 is radially positioned between ends 230*a*, 230*b*, 231*a*, 231*b* and cylindrical outer surface 212 along the outer periphery of end face 220, however, no chamfer is provided between the portions of surfaces 230, 231 circumferentially between ends 230*a*, 230*b*, 231*a*, 231*b* and cylindrical outer surface 212 along the outer periphery of end face 220. Thus, edges 242 are formed at the intersection of each surface 230, 231 and the radially adjacent chamfers 241, and an edge 243 is formed at the intersection of each surface 230, 231 and cylindrical outer surface 212. However, in other embodiments, a chamfer (e.g., chamfer 241) may be disposed at the intersection of one or more of the planar, discrete, circumferentially-spaced regions (e.g., regions 230, 231) and the radially outer cylindrical surface of the cutting layer (e.g., outer surface 212 of cutting layer 210). As will be described in more detail below, each edge 243, and to a lesser extent each surface 242, defines a cutting edge for engaging and shearing the formation during drilling operations. As best shown in FIG. 5B, ends 230*a*, 230*b* of surface 230 and ends 231*a*, 231*b* of surface 231 are angularly spaced apart by an acute angle $\alpha_{230}$, $\alpha_{231}$, respectively, about axis 205 in top view. Each acute angle $\alpha_{230}$, $\alpha_{231}$ preferably ranges from 120° to 5°, and more preferably ranges from 60° to 10°. In this embodiment, both acute angles $\alpha_{230}$, $\alpha_{231}$ are the same, and further, each acute angle $\alpha_{230}$, $\alpha_{231}$ is about 60°.

Referring still to FIG. 5B, each surface 230, 231 has a lateral length $L_{230}$, $L_{231}$, respectively, measured perpendicular to plane 250 between corresponding ends 230*a*, 230*b*, 231*a*, 231*b*, and a thickness $T_{230}$, $T_{231}$, respectively, measured parallel to plane 250 from outer surface 212 to the corresponding edge 240. In this embodiment, each lateral length $L_{230}$, $L_{231}$ is maximum between ends 230*a*, 230*b* and 231*a*, 231*b*, respectively, and each thickness $T_{230}$, $T_{231}$ is maximum along plane 250. In addition, lateral length $L_{230}$, $L_{231}$ is greater than the corresponding thickness $T_{230}$, $T_{231}$, respectively. The ratio of lateral length $L_{230}$, $L_{231}$ to the corresponding thickness $T_{230}$, $T_{231}$, respectively, of each surface 230, 231 preferably ranges from 0.2 to 5.0. In this embodiment, the ratio of lateral length $L_{230}$, $L_{231}$ to the corresponding thickness $T_{230}$, $T_{231}$, respectively, of each surface 230, 231 is the same, and in particular, is about 2.0. In general, the ratio of lateral length $L_{230}$, $L_{231}$ to the corresponding thickness $T_{230}$, $T_{231}$, respectively, of each surface 230, 231 can be varied and may depend on the curvature of the crown 222 and lateral surface 223. In addition, the ratio of lateral length $L_{230}$, $L_{231}$ to the corresponding thickness $T_{230}$, $T_{231}$, respectively, of each surface 230, 231 can be optimized for specific applications, material composition of cutting layer 210, geometry of the cutting layer 210, or combinations thereof.

Referring again to FIGS. 2 and 3, cutter elements 200 are mounted in bit body 110 such that cutting faces 220 are exposed to the formation material, and more particularly, such that one planar surface 230, 231 of each cutter element 200 and the corresponding cutting edge 243 is positioned to shear, excavate, and removing rock from beneath the drill bit 110 during rotary drilling operations. More specifically, each cutter element 200 is mounted to a corresponding blade 141, 142 with substrate 201 received and secured in a pocket formed in the cutter support surface 144 of the blade 141, 142 to which it is fixed by brazing or other suitable means. Each cutter element 200 is positioned and oriented with axis 205 oriented generally parallel or tangent to cutting direction 106 and such that the corresponding end face 220 is exposed and leads the cutter element 200 relative to cutting direction 106 of bit 100. As previously described, cutting faces 220 are forward-facing. In addition, each cutter element 200 is oriented with one planar surface 230, 231 and corresponding edge 243 distal the corresponding cutter supporting surface 144 and the other planar surface 230, 231 and corresponding edge 243 proximal the corresponding cutter supporting surface 144. Consequently, the cutting edge 243 distal the corresponding cutter supporting surface 144 defines an extension height or the corresponding cutter element 200. In general, the extension height of a cutter element (e.g., cutter element 200) is generally the distance from the cutter support surface of the blade to which the cutter element is mounted to the outermost point or portion of the cutter element as measured perpendicular to the cutter supporting surface. The extension heights of cutter elements 200 can be selected to so as to ensure that cutting edges 243 of cutter elements 200 achieve the desired depth of cut, or at least be in contact with the rock during drilling.

During drilling operations, each end face 220 engages, penetrates, and shears the formation as the bit 100 is rotated in the cutting direction 106 and is advanced through the formation. Due to the orientation of cutter elements 200, cutting edges 243 of cutter elements 200 function as the primary cutting edges as cutter elements 200 engage the formation. The sheared formation material slides along planar surfaces 230, 231 associated with the cutting edges 243 that engage the formation, and then slides across boundaries 240 and saddle surfaces 221 as end faces 220 pass through the formation.

The geometry of end face 220, and more specifically surfaces 230, 231 and saddle 221, is particularly designed to offer the potential to improving cutting efficiency and cleaning efficiency to increase rate of penetration (ROP) and durability of bit 100. In particular, the downward slope of saddle surface 221 moving away from each planar surface 230, 231 increases relief relative to the cutting edge 243 engaging the formation and the corresponding planar surface 230, 231, which allows drilling fluid to be directed toward that cutting edge 243 and formation cuttings to efficiently slide along end face 220. In addition, the downward slope of lateral side regions 223 toward base 201 moving laterally from crown 222 allows end face 220 to draw the extrudate of formation material. During cutting, the reduced average surface roughness Ra of planar surfaces 230, 231 offers the potential to reduce friction between the formation material and end face to facilitate more efficient cuttings removal from those regions of end face 220 that experience the greatest stresses. The tailored geometry of end face 220 including saddle surface 221 with crown 222 and lateral sides 223 also offers the potential to improve the efficiency at which formations cuttings are evacuated.

By orienting each cutter element 200 with one surface 230, 231 and corresponding edge 243 adjacent the cutter-supporting surface 144 and the other surface 230, 231 and corresponding edge 243 distal the cutter-supporting surface 144, one surface 230, 231 and corresponding edge 243 engages the formation while the other surface 230, 231 and corresponding edge 243 are spaced from the formation. Thus, once the surface 230, 231 and corresponding edge 243 distal the cutter supporting surface 144 becomes sufficiently worn or damaged, the cutter element 200 can be removed, rotated 180° and reattached to cutter-supporting surface 144 to orient the other surface 230, 231 and corresponding edge 243 for cutting duty.

In general, cutter element 200 can be manufactured using techniques known in the art. In this embodiment, cutter element 200 is manufactured by forming base portion 201 and cutting layer 210. Cutting layer 210 can be fixably mounted to base portion 201 after base portion 201 and cutting layer 210 are formed, or cutting layer 210 can be formed simultaneously with mounting cutting layer 210 to base portion 201 such as by sintering cutting layer 210. For example, powder for forming cutting layer 210 can be placed in a mold or can on top of the pre-formed base portion 201, and then the enhanced pressure and temperature can be applied to the powder to simultaneously form cutting layer 210 and secure cutting layer 210 to base portion 201. Alternatively, surface 221, 230, 231 could be also molded on end face 220 of the cutting layer 210 prior to applying the high pressure and temperature cycle, and then sintered to the pre-formed base portion 201. To enhance smoothness, planar surface 230, 231 can be machined (e.g., polished) following formation of cutting layer 210, while saddle surface 221 is not machined or polished following formation of cutting layer 210 or is lapped to an average surface roughness Ra greater than the average surface roughness Ra of the machined or polished planar surfaces 230, 231. In some embodiments, cutting layer 210 is formed with saddle surface 221 but without planar surfaces 230, 231, and then saddle surface 221 is machined to form planar surfaces 230, 231.

Referring now to FIGS. 6A-6D, another embodiment of a cutter element 300 is shown. In general, a plurality of cutter elements 300 can be used in place of cutter elements 200 on bit 100 previously described.

Cutter element 300 is substantially the same as cutter element 200 previously described with the exception of the size and geometry of the planar surfaces on the cutting face. More specifically, in this embodiment, cutter element 300 includes a base 201 and a cutting disc or layer 210 bonded to the base 201 at a plane of intersection 209. Base 201 and cutting layer 210 are each as previously described. Thus, base 201 has a central axis 205, a first end 201*a* bonded to cutting layer 210, a second end 201*b* distal cutting layer 210, and a radially outer surface 202 extending axially between ends 201*a*, 201*b*. In addition, cutting layer 210 has a first end

Figure 6A:
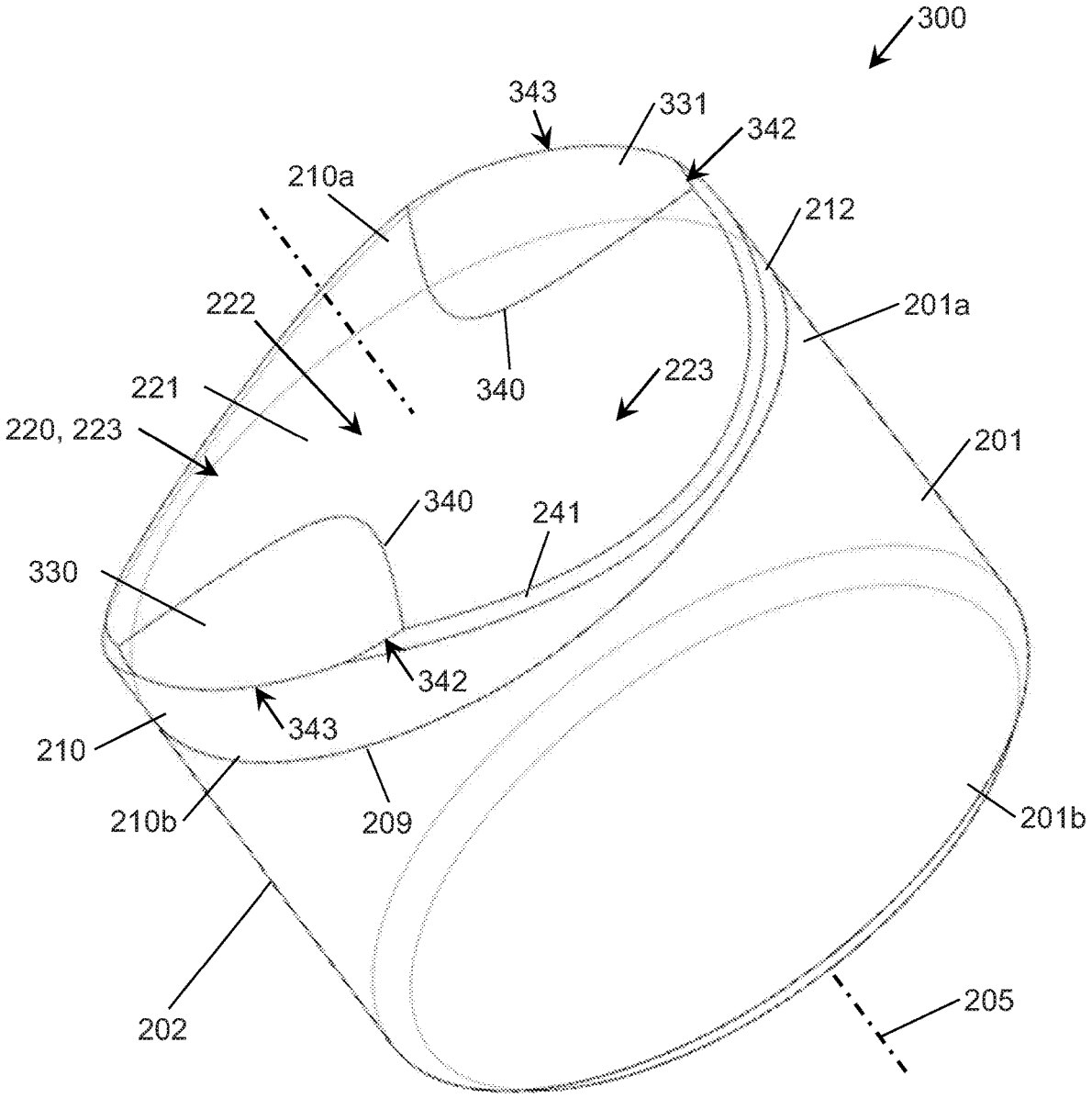
FIGS. 6A-6D are perspective, top, front side, and lateral side views, respectively, of an embodiment of a cutter element in accordance with the principles described herein.
Figure 6B:
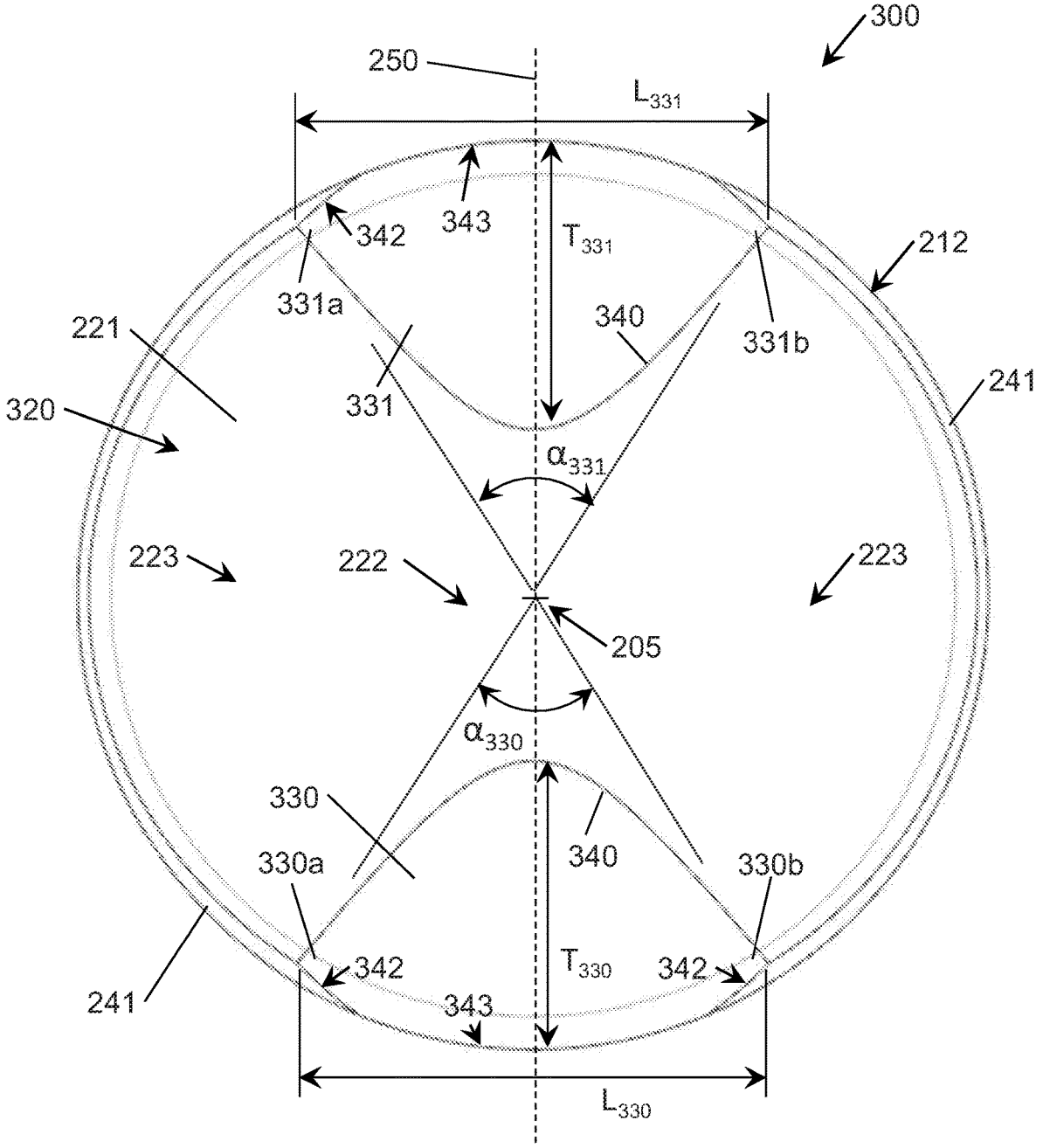
Figure 6C:
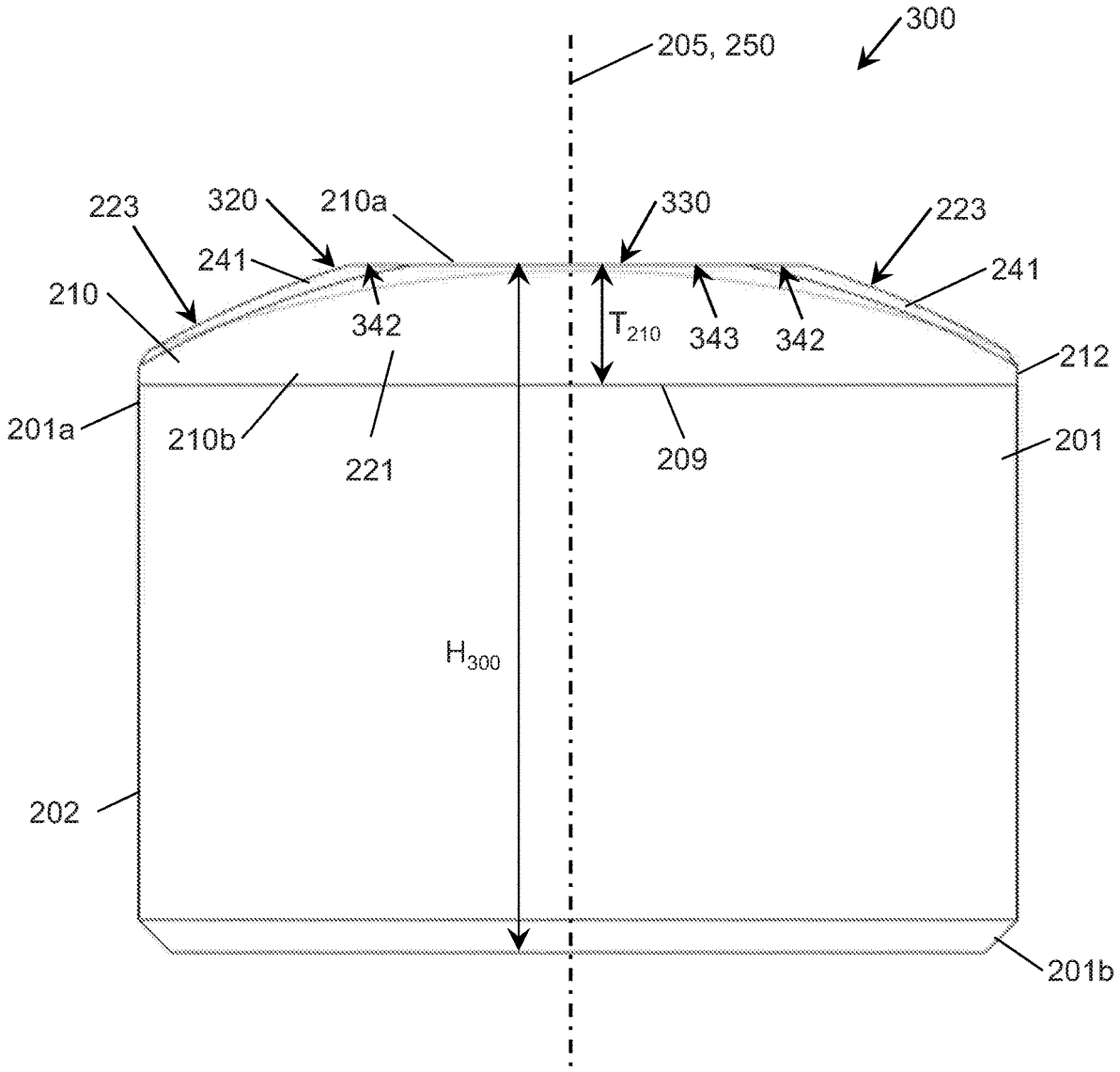
Figure 6D:
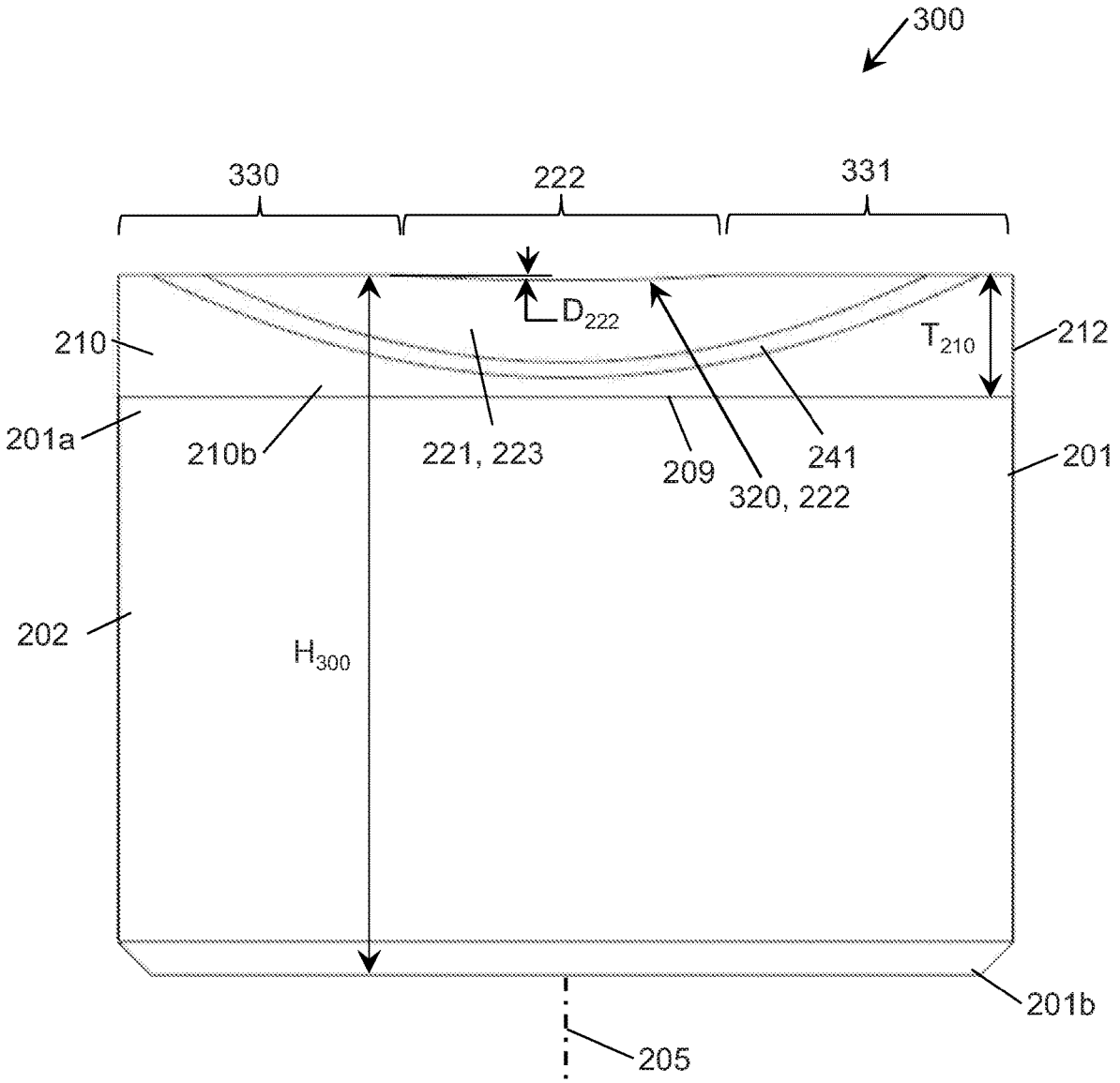

210*a* distal substrate 201, a second end 210*b* bonded to end 201*a* of substrate 201, and a radially outer surface 212 extending axially between ends 210*a*, 210*b*. In addition, cutting layer 210 has a thickness $T_{210}$ in side view (front and lateral side views) measured axially from end 210*a* to plane of intersection 209 and end 210*b*. The outer surface of cutting layer 210 at first end 210*a* defines the cutting or end face 320 of cutter element 300. As best shown in FIGS. 6C and 6D, cutter element 300 has a height $H_{300}$ in side view (front and lateral side view) measured axially from end 201*b* to end face 320 and end 201*a*.

End face 320 includes a saddle surface 221 and a plurality of discrete, circumferentially-spaced regions or surfaces 330, 331 that intersect saddle surface 221 at curved boundaries or edges 340. Saddle surface 221 is as previously described, and thus, includes crown 222 and lateral side surfaces 223 as previously described. Crown 222 has a depth $D_{222}$ measured axially from a plane oriented perpendicular to axis 205 and containing the axially uppermost point or surface along end face 220 of cutting layer 210 to crown 222. As previously described, the ratio of the maximum depth $D_{222}$ of crown to the maximum thickness $T_{210}$ of cutting layer is preferably at least 0.10.

Surfaces 330, 331 are similar to surfaces 230, 231 previously described. In particular, surfaces 330, 331 are circumferentially-spaced about end face 320. In this embodiment, two surfaces 330, 331 are provided on end face 320 and are uniformly circumferentially-spaced 180° apart. Thus, surfaces 330, 331 are radially opposed (across axis 205) and disposed on opposite ends of end face 320. More specifically, surfaces 330, 331 are disposed at opposite ends of crown 222 and are centered on and symmetric about reference plane 250. In addition, each surface 330, 331 is radially positioned between saddle surface 221 and outer cylindrical surface 212. As best shown in FIG. 6B, the radially inner boundary of each surface 330, 331 is generally convex in top view, and thus, edges 340 are generally U-shaped.

In this embodiment, surfaces 330, 331 are smoother than saddle surface 221. In particular, surfaces 330, 331 are polished to an average surface roughness Ra that is less than the average surface roughness Ra of saddle surface 221. The average surface roughness Ra of each surface 330, 331 preferably ranges from 0.05 micron to 1.0 micron, and more preferably ranges from 0.05 micron to 0.2 micron, whereas the average surface roughness Ra of saddle surface 221 ranges from 0.05 micron to 1.5 micron.

As best shown in FIGS. 6C and 6D, and similar to surfaces 230, 231, in this embodiment, each surface 330, 231 is a flat, and thus, may also be referred to as a planar surface or facet. In addition, each surface 330, 331 is disposed in a plane oriented perpendicular to axis 205 and reference plane 250. In this embodiment, both surfaces 330, 331 are disposed in a common plane oriented perpendicular to axis 205 and reference plane 250. Thus, the height $H_{300}$ of cutter element 300 is uniform and constant along surfaces 330, 331. It should also be appreciated that since surfaces 330, 331 are disposed at opposite ends of crown 222, which is concave therebetween, and lateral surfaces 223 generally slope downward moving from surfaces 330, 331 to chamfers 241, the height $H_{300}$ of cutter element 300 is maximum along surfaces 330, 331. The height of cutter element 300 generally decreases moving from each surface 330, 331 to axis 205 along crown 222, and further, the height $H_{300}$ generally decreases moving from each surface 330, 331 along each lateral surface 223.

Referring now to FIG. 6B, each surface 330, 331 has circumferential ends 330*a*, 330*b*, 331*a*, 331*b*, respectively. In this embodiment, chamfer 241 is radially positioned between ends 330*a*, 330*b*, 331*a*, 331*b* and cylindrical outer surface 212 along the outer periphery of end face 320, however, no chamfer is provided between the portions of surfaces 330, 331 circumferentially between ends 330*a*, 330*b*, 331*a*, 331*b* and cylindrical outer surface 212 along the outer periphery of end face 320. Thus, edges 342 are formed at the intersection of each surface 330, 331 and the radially adjacent chamfers 241, and an edge 343 is formed at the intersection of each surface 330, 331 and cylindrical outer surface 212. As will be described in more detail below, each edge 343, and to a lesser extent each surface 342, defines a cutting edge for engaging and shearing the formation during drilling operations. As best shown in FIG. 6B, ends 330*a*, 330*b* of surface 330 and ends 331*a*, 331*b* of surface 331 are angularly spaced apart by an acute angle $\alpha_{330}$, $\alpha_{331}$, respectively, about axis 205 in top view. Each acute angle $\alpha_{330}$, $\alpha_{331}$ preferably ranges from 120° to 5°, and more preferably ranges from 60° to 10°. In this embodiment, both acute angles $\alpha_{330}$, $\alpha_{331}$ are the same, and further, each acute angle $\alpha_{330}$, $\alpha_{331}$ is about 60°.

Referring still to FIG. 6B, each surface 330, 331 has a lateral length $L_{330}$, $L_{331}$, respectively, measured perpendicular to plane 250 between corresponding ends 330*a*, 330*b*, 331*a*, 331*b*, and a thickness $T_{330}$, $T_{331}$, respectively, measured parallel to plane 250 from outer surface 212 to the corresponding edge 340. In this embodiment, each lateral length $L_{330}$, $L_{331}$ is maximum between ends 330*a*, 330*b* and 331*a*, 331*b*, respectively, and each thickness $T_{330}$, $T_{331}$ is maximum along plane 250. In addition, lateral length $L_{330}$, $L_{331}$ is greater than the corresponding thickness $T_{330}$, $T_{331}$, respectively. As previously described, the ratio of lateral length $L_{330}$, $L_{331}$ to the corresponding thickness $T_{330}$, $T_{331}$, respectively, of each surface 330, 331 preferably ranges from 0.2 to 5.0. n this embodiment, the ratio of lateral length $L_{330}$, $L_{331}$ to the corresponding thickness $T_{330}$, $T_{331}$, respectively, of each surface 330, 331 is the same, and in particular, is 1.5. As previously described, the ratio of lateral length $L_{330}$, $L_{331}$ to the corresponding thickness $T_{330}$, $T_{331}$, respectively, of each surface 330, 331 can be varied and may depend on the curvature of the crown 222 and lateral surface 223. In addition, the ratio of lateral length $L_{330}$, $L_{331}$ to the corresponding thickness $T_{330}$, $T_{331}$, respectively, of each surface 330, 331 can be optimized for specific applications, material composition of cutting layer 210, geometry of the cutting layer 210, or combinations thereof.

Cutter elements 300 are mounted in a bit body (e.g., bit body 110) in the same manner and orientation as cutter elements 200 previously described. More specifically, each cutter element 300 is mounted to a corresponding blade (e.g., blade 141, 142) with substrate 201 received and secured in a pocket formed in the cutter support surface (e.g., cutter supporting surface 144) of the blade to which it is fixed by brazing or other suitable means. In addition, each cutter element 300 is oriented with axis 205 oriented generally parallel or tangent to cutting direction 106 and such that the corresponding end face 320 is exposed and leads the cutter element 300 relative to cutting direction of the bit (e.g., direct 106 of bit 100). Further, cutter elements 300 are oriented with one planar surface 330, 331 and corresponding edge 343 distal the corresponding cutter supporting surface and the other planar surface 330, 331 and corresponding edge 343 proximal the corresponding cutter supporting surface. Consequently, the cutting edge 343 distal the corresponding cutter supporting surface defines an extension height or the corresponding cutter element 300.

During drilling operations, each end face 320 engages, penetrates, and shears the formation as the bit is rotated in the cutting direction and is advanced through the formation. Due to the orientation of cutter elements 300, cutting edges 343 of cutter elements 300 function as the primary cutting edges as cutter elements 300 engage the formation. The sheared formation material slides along planar surfaces 330, 331 associated with the cutting edges 343 that engage the formation, and then slides across boundaries 340 and saddle surfaces 221 as cutting faces 320 pass through the formation.

The geometry of end face 320, and more specifically surfaces 330, 331 and saddle 221, is particularly designed to offer the potential to improving cutting efficiency and cleaning efficiency to increase rate of penetration (ROP) and durability of the bit in the same manner as previously described with respect to cutter element 200. For example, the downward slope of saddle surface 221 moving away from each planar surface 330, 331 increases relief relative to the cutting edge 343 engaging the formation and the corresponding planar surface 330, 331, which allows drilling fluid to be directed toward that cutting edge 343 and formation cuttings to efficiently slide along end face 320. In addition, the downward slope of lateral side regions 223 toward base 201 moving laterally from crown 222 allows end face 220 to draw the extrudate of formation material. During cutting, the reduced average surface roughness Ra of planar surfaces 330, 331 offers the potential to reduce friction between the formation material and end face to facilitate more efficient cuttings removal from those regions of end face 320 that experience the greatest stresses. The tailored geometry of end face 320 including saddle surface 221 with crown 222 and lateral sides 223 also offers the potential to improve the efficiency at which formations cuttings are evacuated. In addition, due to the circumferential spacing of surfaces 330, 331 and orientation of cutter elements 300 with one surface 330, 331 and corresponding edge 343 adjacent the cutter-supporting surface and the other surface 330, 331 and corresponding edge 343 distal the cutter-supporting surface, one surface 330, 331 and corresponding edge 343 engages the formation while the other surface 330, 331 and corresponding edge 343 are spaced from the formation, thereby enabling the cutter element 300 to be removed, rotated 180° and reattached to cutter-supporting surface 144 to orient the other surface 330, 331 and corresponding edge 343 for cutting duty. In general, cutter element 300 can be manufactured in the same manner as cutter element 200 previously described.

Referring now to FIGS. 7A-7D, another embodiment of a cutter element 400 is shown. In general, a plurality of cutter elements 400 can be used in place of cutter elements 200 on bit 100 previously described.

Figure 7A:
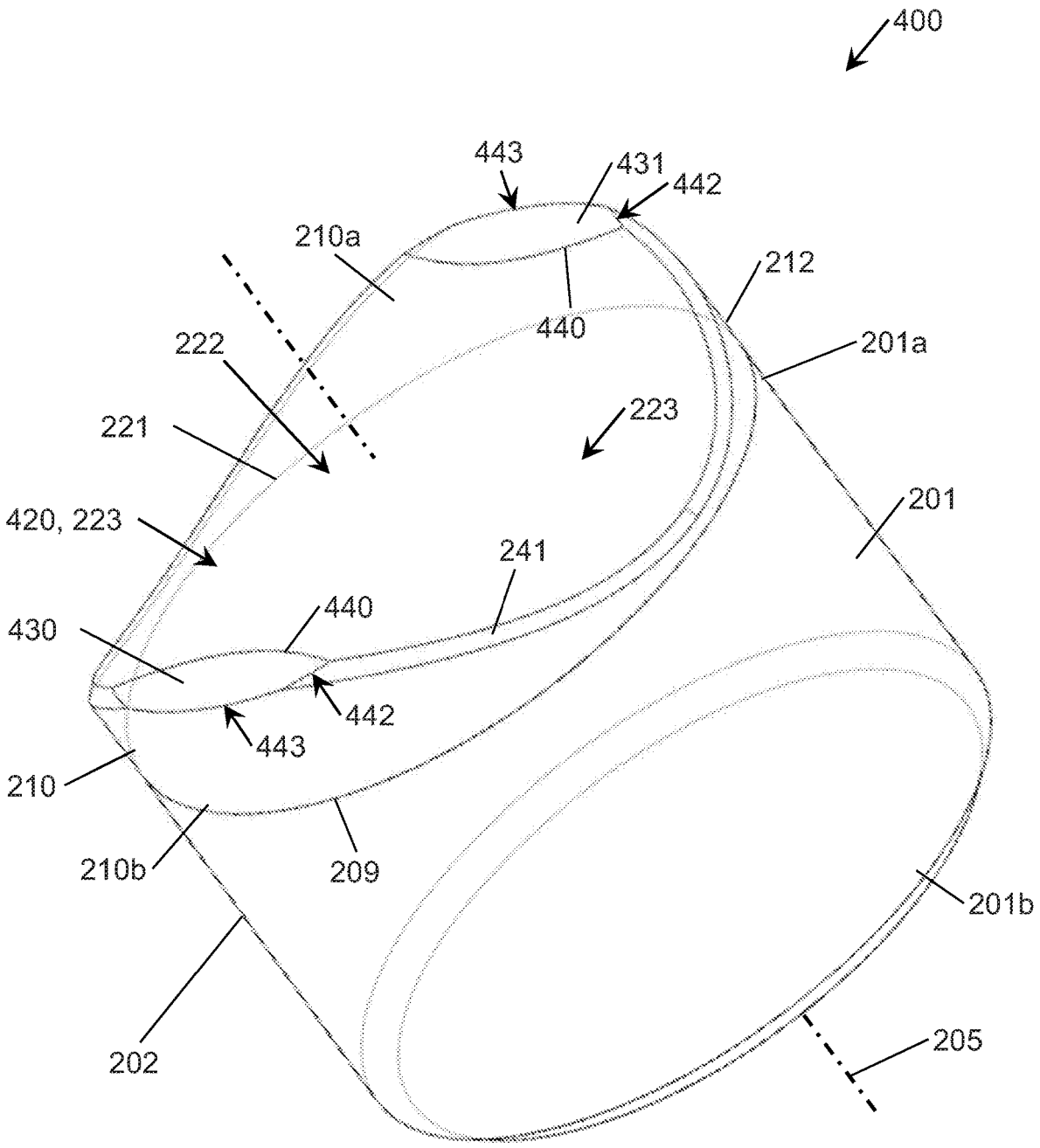
FIGS. 7A-7D are perspective, top, front side, and lateral side views, respectively, of an embodiment of a cutter element in accordance with the principles described herein.
Figure 7B:
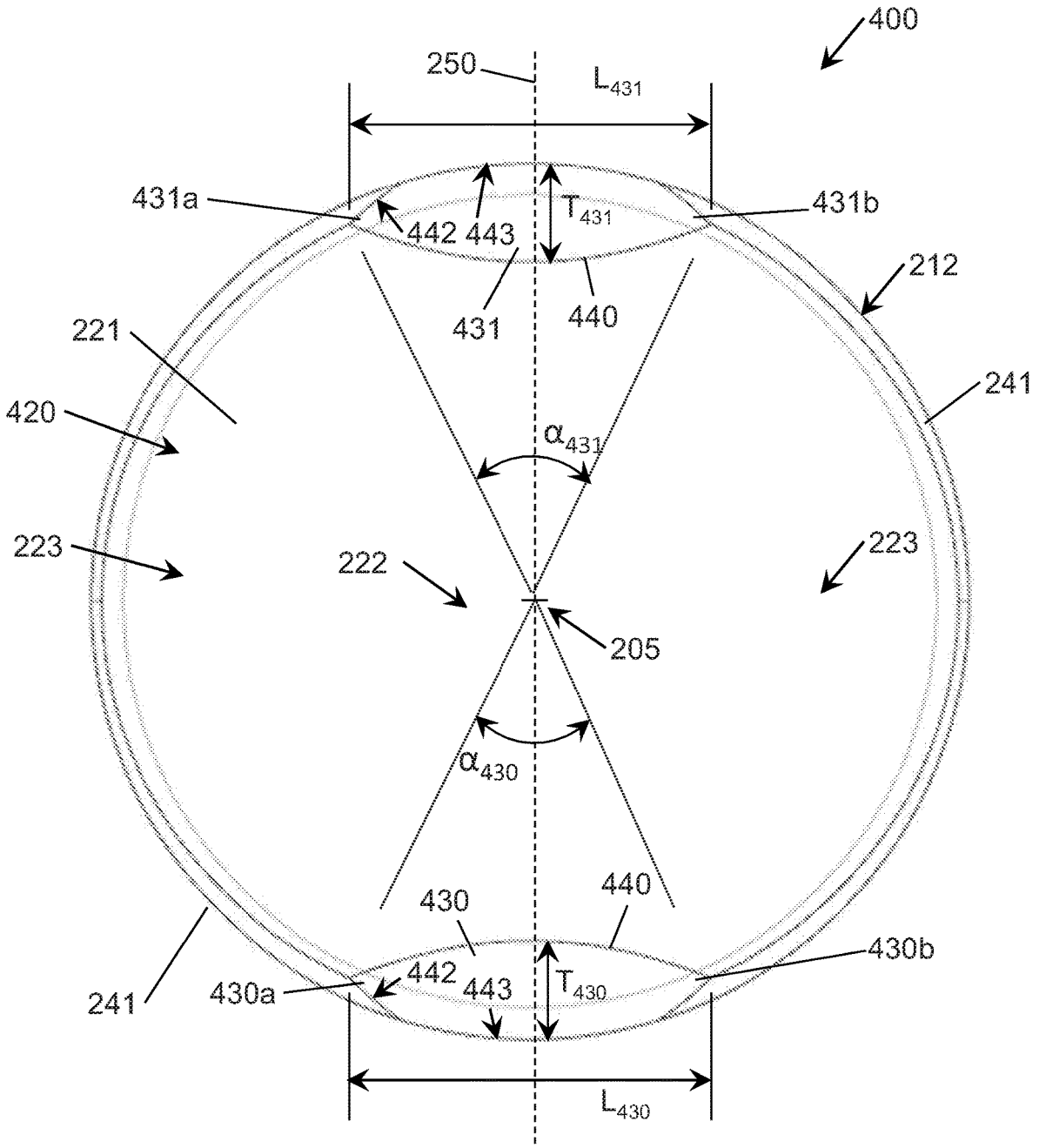
Figure 7C:
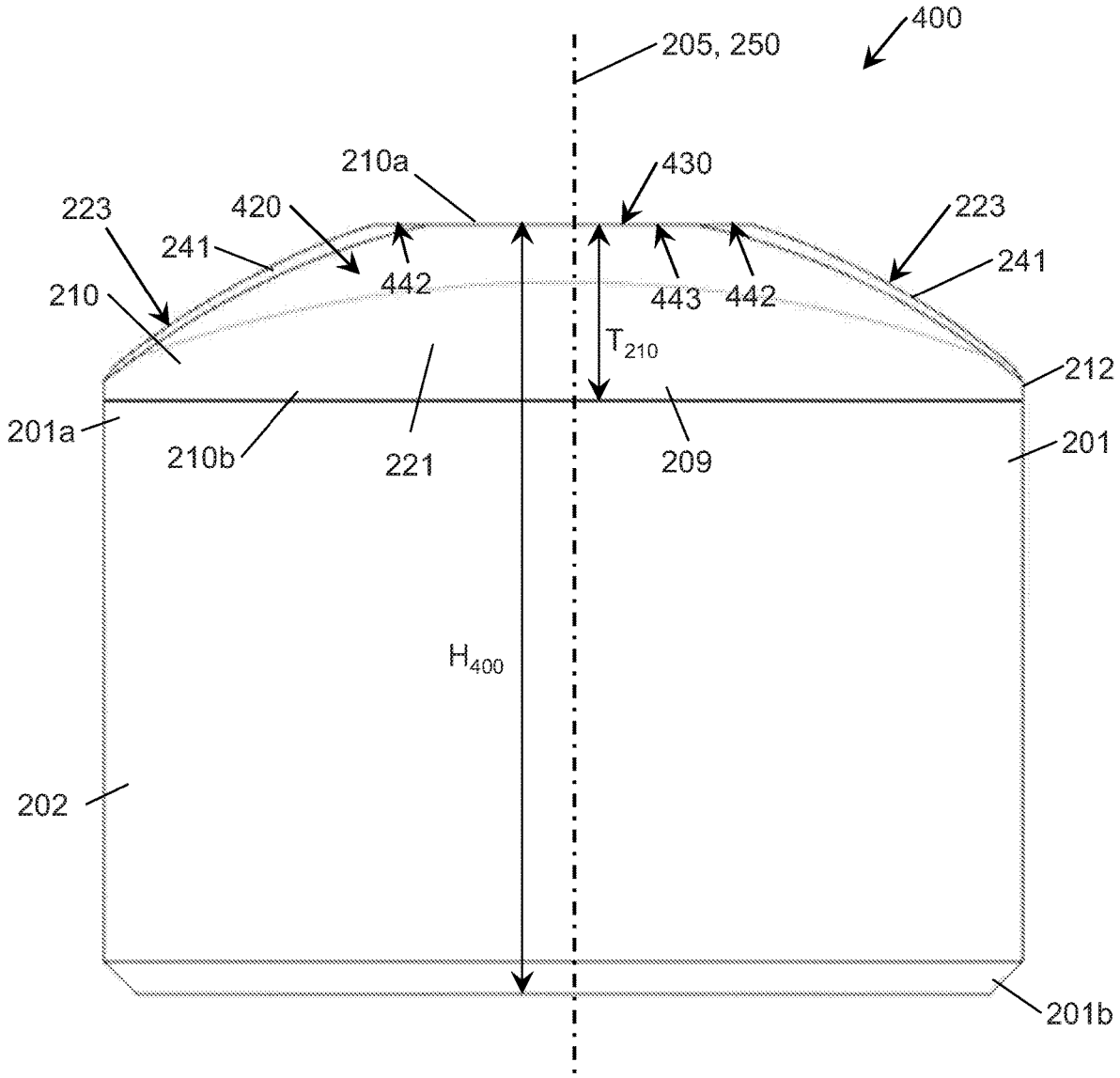
Figure 7D:
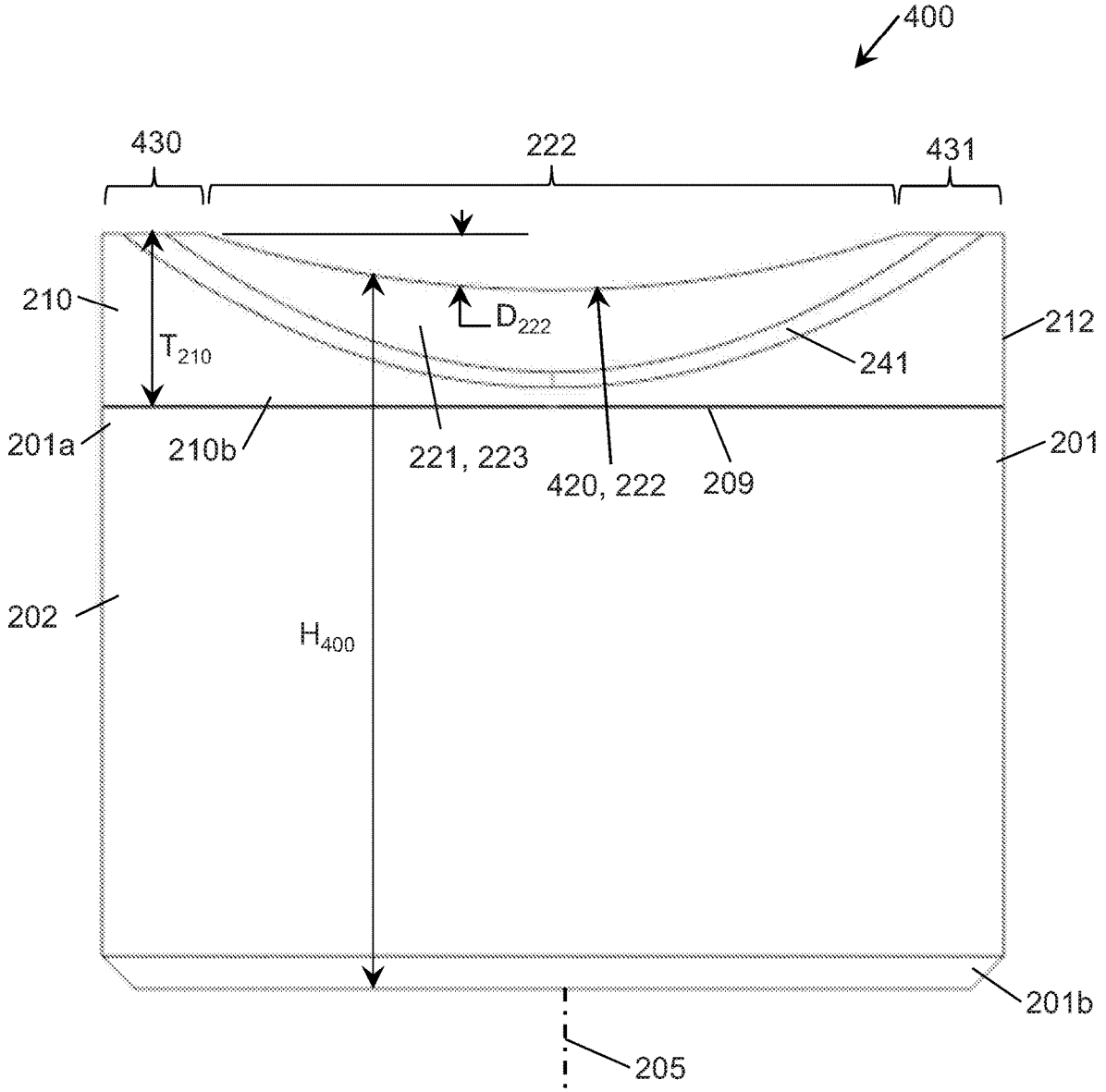

Cutter element 400 is substantially the same as cutter elements 200, 300 previously described with the exception of the size and geometry of the planar surfaces on the cutting face. More specifically, in this embodiment, cutter element 400 includes a base 201 and a cutting disc or layer 210 bonded to the base 201 at a plane of intersection 209. Base 201 and cutting layer 210 are each as previously described. Thus, base 201 has a central axis 205, a first end 201*a* bonded to cutting layer 210, a second end 201*b* distal cutting layer 210, and a radially outer surface 202 extending axially between ends 201*a*, 201*b*. In addition, cutting layer 210 has a first end 210*a* distal substrate 201, a second end 210*b* bonded to end 201*a* of substrate 201, and a radially outer surface 212 extending axially between ends 210*a*, 210*b*. In addition, cutting layer 210 has a thickness $T_{210}$ in side view (front and lateral side views) measured axially from end 210*a* to plane of intersection 209 and end 210*b*. The outer surface of cutting layer 210 at first end 210*a* defines the cutting or end face 420 of cutter element 300. As best shown in FIGS. 7C and 7D, cutter element 400 has a height $H_{400}$ in side view (front and lateral side view) measured axially from end 201*b* to end face 420 and end 201*a*.

End face 420 includes a saddle surface 221 and a plurality of discrete, circumferentially-spaced regions or surfaces 430, 431 that intersect saddle surface 221 at curved boundaries or edges 440. Saddle surface 221 is as previously described, and thus, includes crown 222 and lateral side surfaces 223 as previously described. Crown 222 has a depth $D_{222}$ measured axially from a plane oriented perpendicular to axis 205 and containing the axially uppermost point or surface along end face 220 of cutting layer 210 to crown 222. As previously described, the ratio of the maximum depth $D_{222}$ of crown to the maximum thickness $T_{210}$ of cutting layer is preferably at least 0.10.

Surfaces 430, 431 are similar to surfaces 230, 231 previously described. In particular, surfaces 430, 431 are circumferentially-spaced about end face 420. In this embodiment, two surfaces 430, 431 are provided on end face 420 and are uniformly circumferentially-spaced 180° apart. Thus, surfaces 430, 431 are radially opposed (across axis 205) and disposed on opposite ends of end face 420. More specifically, surfaces 430, 431 are disposed at opposite ends of crown 222 and are centered on and symmetric about reference plane 250. In addition, each surface 430, 431 is radially positioned between saddle surface 221 and outer cylindrical surface 212. As best shown in FIG. 7B, the radially inner boundary of each surface 430, 431 is generally convex in top view, and thus, edges 440 are generally U-shaped.

In this embodiment, surfaces 430, 431 are smoother than saddle surface 221. In particular, surfaces 430, 431 are polished to an average surface roughness Ra that is less than the average surface roughness Ra of saddle surface 221. The average surface roughness Ra of each surface 430, 431 preferably ranges from 0.05 micron to 1.0 micron, and more preferably ranges from 0.05 micron to 0.2 micron, whereas the average surface roughness Ra of saddle surface 221 ranges from 0.05 micron to 1.5 micron.

As best shown in FIGS. 7C and 7D, and similar to surfaces 230, 231, in this embodiment, each surface 430, 431 is a flat, and thus, may also be referred to as a planar surface or facet. In addition, each surface 430, 431 is disposed in a plane oriented perpendicular to axis 205 and reference plane 250. In this embodiment, both surfaces 430, 431 are disposed in a common plane oriented perpendicular to axis 205 and reference plane 250. Thus, the height $H_{400}$ of cutter element 400 is uniform and constant along surfaces 430, 431. It should also be appreciated that since surfaces 430, 431 are disposed at opposite ends of crown 222, which is concave therebetween, and lateral surfaces 223 generally slope downward moving from surfaces 430, 431 to chamfers 241, the height $H_{400}$ of cutter element 400 is maximum along surfaces 430, 431. The height of cutter element 400 generally decreases moving from each surface 430, 431 to axis 205 along crown 222, and further, the height $H_{400}$ generally decreases moving from each surface 430, 431 along each lateral surface 223.

Referring now to FIG. 7B, each surface 430, 431 has circumferential ends 430*a*, 430*b*, 431*a*, 431*b*, respectively. In this embodiment, chamfer 241 is radially positioned between ends 430*a*, 430*b*, 431*a*, 431*b* and cylindrical outer surface 212 along the outer periphery of end face 420, however, no chamfer is provided between the portions of surfaces 430, 431 circumferentially between ends 430*a*,

430*b*, 431*a*, 431*b* and cylindrical outer surface 212 along the outer periphery of end face 420. Thus, edges 442 are formed at the intersection of each surface 430, 431 and the radially adjacent chamfers 241, and an edge 443 is formed at the intersection of each surface 430, 431 and cylindrical outer surface 212. As will be described in more detail below, each edge 443, and to a lesser extent each surface 442, defines a cutting edge for engaging and shearing the formation during drilling operations. As best shown in FIG. 7B, ends 430*a*, 430*b* of surface 430 and ends 431*a*, 431*b* of surface 431 are angularly spaced apart by an acute angle $\alpha_{430}$, $\alpha_{431}$, respectively, about axis 205 in top view. Each acute angle $\alpha_{430}$, $\alpha_{431}$ preferably ranges from 120° to 5°, and more preferably ranges from 60° to 10°. In this embodiment, both acute angles $\alpha_{430}$, $\alpha_{431}$ are the same, and further, each acute angle $\alpha_{430}$, $\alpha_{431}$ is about 50°.

Referring still to FIG. 7B, each surface 430, 431 has a lateral length $L_{430}$, $L_{431}$, respectively, measured perpendicular to plane 250 between corresponding ends 430*a*, 430*b*, 431*a*, 431*b*, and a thickness $T_{430}$, $T_{431}$, respectively, measured parallel to plane 250 from outer surface 212 to the corresponding edge 440. In this embodiment, each lateral length $L_{430}$, $L_{431}$ is maximum between ends 430*a*, 430*b* and 431*a*, 431*b*, respectively, and each thickness $T_{430}$, $T_{431}$ is maximum along plane 250. In addition, lateral length $L_{430}$, $L_{431}$ is greater than the corresponding thickness $T_{430}$, $T_{431}$, respectively. As previously described, the ratio of lateral length $L_{430}$, $L_{431}$ to the corresponding thickness $T_{430}$, $T_{431}$, respectively, of each surface 430, 431 preferably ranges from 0.2 to 5.0. n this embodiment, the ratio of lateral length $L_{430}$, $L_{431}$ to the corresponding thickness $T_{430}$, $T_{431}$, respectively, of each surface 430, 431 is the same, and in particular, is about 4.0. As previously described, the ratio of lateral length $L_{430}$, $L_{431}$ to the corresponding thickness $T_{430}$, $T_{431}$, respectively, of each surface 430, 431 can be varied and may depend on the curvature of the crown 222 and lateral surface 223. In addition, the ratio of lateral length $L_{430}$, $L_{431}$ to the corresponding thickness $T_{430}$, $T_{431}$, respectively, of each surface 430, 431 can be optimized for specific applications, material composition of cutting layer 210, geometry of the cutting layer 210, or combinations thereof.

Cutter elements 400 are mounted in a bit body (e.g., bit body 110) in the same manner and orientation as cutter elements 200 previously described. More specifically, each cutter element 400 is mounted to a corresponding blade (e.g., blade 141, 142) with substrate 201 received and secured in a pocket formed in the cutter support surface (e.g., cutter supporting surface 144) of the blade to which it is fixed by brazing or other suitable means. In addition, each cutter element 400 is oriented with axis 205 oriented generally parallel or tangent to cutting direction 106 and such that the corresponding end face 420 is exposed and leads the cutter element 400 relative to cutting direction of the bit (e.g., direct 106 of bit 100). Further, cutter elements 400 are oriented with one planar surface 430, 431 and corresponding edge 443 distal the corresponding cutter supporting surface and the other planar surface 430, 431 and corresponding edge 443 proximal the corresponding cutter supporting surface. Consequently, the cutting edge 443 distal the corresponding cutter supporting surface defines an extension height or the corresponding cutter element 400.

During drilling operations, each end face 420 engages, penetrates, and shears the formation as the bit is rotated in the cutting direction and is advanced through the formation. Due to the orientation of cutter elements 400, cutting edges 443 of cutter elements 300 function as the primary cutting edges as cutter elements 400 engage the formation. The sheared formation material slides along planar surfaces 430, 431 associated with the cutting edges 443 that engage the formation, and then slides across boundaries 440 and saddle surfaces 221 as cutting faces 420 pass through the formation.

The geometry of end face 420, and more specifically surfaces 430, 431 and saddle 221, is particularly designed to offer the potential to improving cutting efficiency and cleaning efficiency to increase rate of penetration (ROP) and durability of the bit in the same manner as previously described with respect to cutter element 200. For example, the downward slope of saddle surface 221 moving away from each planar surface 430, 431 increases relief relative to the cutting edge 443 engaging the formation and the corresponding planar surface 430, 431, which allows drilling fluid to be directed toward that cutting edge 443 and formation cuttings to efficiently slide along end face 420. In addition, the downward slope of lateral side regions 223 toward base 201 moving laterally from crown 222 allows end face 220 to draw the extrudate of formation material. During cutting, the reduced average surface roughness Ra of planar surfaces 430, 431 offers the potential to reduce friction between the formation material and end face to facilitate more efficient cuttings removal from those regions of end face 420 that experience the greatest stresses. The tailored geometry of end face 420 including saddle surface 221 with crown 222 and lateral sides 223 also offers the potential to improve the efficiency at which formations cuttings are evacuated. In addition, due to the circumferential spacing of surfaces 430, 431 and orientation of cutter elements 400 with one surface 430, 431 and corresponding edge 443 adjacent the cutter-supporting surface and the other surface 430, 431 and corresponding edge 443 distal the cutter-supporting surface, one surface 430, 431 and corresponding edge 443 engages the formation while the other surface 430, 431 and corresponding edge 443 are spaced from the formation, thereby enabling the cutter element 400 to be removed, rotated 180° and reattached to cutter-supporting surface 144 to orient the other surface 430, 431 and corresponding edge 443 for cutting duty. In general, cutter element 400 can be manufactured in the same manner as cutter element 200 previously described.

While preferred embodiments have been shown and described, modifications thereof can be made by one skilled in the art without departing from the scope or teachings herein. The embodiments described herein are exemplary only and are not limiting. Many variations and modifications of the systems, apparatus, and processes described herein are possible and are within the scope of the disclosure. For example, the relative dimensions of various parts, the materials from which the various parts are made, and other parameters can be varied. Accordingly, the scope of protection is not limited to the embodiments described herein, but is only limited by the claims that follow, the scope of which shall include all equivalents of the subject matter of the claims. Unless expressly stated otherwise, the steps in a method claim may be performed in any order. The recitation of identifiers such as (a), (b), (c) or (1), (2), (3) before steps in a method claim are not intended to and do not specify a particular order to the steps, but rather are used to simplify subsequent reference to such steps.

What is claimed is:

1. A cutter element for a drill bit configured to drill a borehole in a subterranean formation, the cutter element comprising:

a base portion having a central axis, a first end, a second end, and a radially outer cylindrical surface extending axially from the first end;

a cutting layer fixably mounted to the first end of the base portion, wherein the cutting layer includes a cutting face distal the base portion and a radially outer cylindrical surface extending axially from the cutting face to the radially outer cylindrical surface of the base portion, wherein the radially outer cylindrical surface of the cutting layer is contiguous with the radially outer cylindrical surface of the base portion;

wherein the cutting face comprises:

a first planar surface and a second planar surface that is circumferentially-spaced from the first planar surface, wherein each planar surface is positioned at an outer periphery of the cutting face adjacent the radially outer surface of the cutting layer;

a saddle surface including a concave crown and a pair of lateral side surfaces that slope down and away from the crown toward the radially outer cylindrical surface of the cutting layer, wherein the crown extends from the first planar surface to the second planar surface.

2. The cutter element of claim 1, wherein the saddle surface is a hyperbolic paraboloid surface such that the lateral side surfaces comprise convex surfaces.

3. The cutter element of claim 2, wherein each planar surface intersects the hyperbolic paraboloid surface at an arcuate edge.

4. The cutter element of claim 1, wherein the first planar surface and the second planar surface are disposed in a common plane.

5. The cutter element of claim 1, wherein the first planar surface and the second planar surface extend along a common plane, and wherein the common plane is oriented perpendicular to the central axis of the base portion.

6. The cutter element of claim 1, wherein first planar surface is disposed in a plane oriented perpendicular to the central axis of the base portion.

7. The cutter element of claim 1, wherein the crown extends linearly in top view from the first planar surface to the second planar surface.

8. The cutter element of claim 7, wherein the saddle surface is symmetric about a reference plane that contains the central axis of the base portion and bisects the cutter element.

9. The cutter element of claim 8, wherein the first planar surface and the second planar surface are symmetric about the reference plane.

10. The cutter element of claim 1, wherein the first planar surface is angularly spaced 180° from the second planar surface about the central axis of the base portion.

11. The cutter element of claim 1, wherein each planar surface extends circumferentially from a first end to a second end that is circumferentially-spaced from the first end, wherein the first end of the first planar surface is angularly spaced from the second end of the first planar surface by an acute angle $\alpha 1$ and the first end of the second planar surface is angularly spaced from the second end of the second planar surface by an acute angle $\alpha 2$.

12. The cutter element of claim 11, wherein each acute angle $\alpha 1$, $\alpha 2$ is between 10° and 60°.

13. The cutter element of claim 11, wherein the crown of the saddle surface extends linearly in top view along a reference plane containing the central axis of the base portion;

wherein the reference plane extends through each planar surface and is oriented perpendicular to each planar surface;

wherein each planar surface has a length measured perpendicularly to the reference plane from the first end of the planar surface to the second end of the planar surface;

wherein each planar surface has a thickness measured parallel to the reference plane from the radially outer cylindrical surface of the base portion to the saddle surface;

wherein the length of each planar surface is greater than the thickness of each planar surface.

14. The cutter element of claim 1, wherein each planar surface has an average surface roughness Ra that is less than an average surface roughness Ra of the saddle surface.

15. The cutter element of claim 14, wherein the average surface roughness Ra of each planar surface ranges from 0.05 micron to 0.2 micron.

16. A cutter element for a drill bit configured to drill a borehole in a subterranean formation, the cutter element comprising:

a base portion having a central axis, a first end, a second end, and a radially outer cylindrical surface extending axially from the first end;

a cutting layer fixably mounted to the first end of the base portion, wherein the cutting layer includes a cutting face distal the base portion and a radially outer cylindrical surface extending axially from the cutting face to the radially outer cylindrical surface of the base portion, wherein the radially outer cylindrical surface of the cutting layer is contiguous with the radially outer cylindrical surface of the base portion;

wherein the cutting face comprises:

a pair of circumferentially-spaced and radially opposed planar surfaces; and a hyperbolic paraboloid surface including a concave crown extending between the pair of planar surfaces and a pair of lateral side surfaces sloping downward and away from the crown toward the radially outer cylindrical surface of the cutting layer.

17. The cutter element of claim 16, wherein each planar surface intersects the hyperbolic paraboloid surface along a U-shaped edge.

18. The cutter element of claim 17, wherein a chamfered surface is disposed between each lateral side surface of the hyperbolic paraboloid surface and the radially outer cylindrical surface of the cutting layer.

19. The cutter element of claim 18, wherein each planar surface is disposed in a plane oriented perpendicular to the central axis.

20. The cutter element of claim 16, wherein each planar surfaces has an average surface roughness Ra less than an average surface roughness Ra of the hyperbolic parabaloid surface.

21. The cutter element of claim 20, wherein the average surface roughness Ra of each planar surface ranges from 0.05 micron to 0.2 micron.

22. The cutter element of claim 16, wherein each planar surface extends along a common plane oriented perpendicular to the central axis; and wherein the cutter element has a height measured axially from the second end of the base portion to the cutting face, wherein the height of the cutter element is a maximum along each planar surface.

23. A method of manufacturing a cutter element for a drill bit, comprising:

(a) forming a base portion having a central axis, a first end, a second end, and a radially outer cylindrical surface extending axially from the first end;

(b) forming a cutting layer that includes a cutting face and a radially outer cylindrical surface extending axially from the cutting face;

(c) fixably mounting the cutting layer to the base portion such that the radially outer cylindrical surface of the cutting layer extends axially from the cutting face to the radially outer cylindrical surface of the base portion and the radially outer cylindrical surface of the cutting layer is contiguous with the radially outer cylindrical surface of the base portion;

wherein the cutting face comprises:

a pair of circumferentially-spaced, radially opposed planar surfaces; and a hyperbolic paraboloid surface including a concave crown extending between the pair of planar surfaces; and (d) machining the planar surfaces to have a lower average surface roughness Ra than the hyperbolic paraboloid surface.

24. The method of claim 23, wherein (d) comprises polishing the planar surfaces, but not the hyperbolic paraboloid surface.

25. The method of claim 23, wherein (d) comprises laping the hyperbolic paraboloid surface.

26. The method of claim 23, wherein (b) and (c) comprise sintering the cutting layer and mounting the cutting layer to the base portion in a single manufacturing step.

27. The method of claim 23, wherein (b) comprises sintering the cutting layer to form the hyperbolic paraboloid surface and then machining the planar surfaces onto the cutting layer.

* * * * *